US009592978B2

(12) United States Patent
Suetaka et al.

(10) Patent No.: US 9,592,978 B2
(45) Date of Patent: Mar. 14, 2017

(54) MEDIUM PROTECTION DEVICE AND MEDIUM SEPARATING AND STACKING DEVICE

(71) Applicant: Oki Electric Industry Co., Ltd., Tokyo (JP)

(72) Inventors: Michio Suetaka, Tokyo (JP); Takamoto Yokote, Tokyo (JP); Satoru Iwasaki, Tokyo (JP); Hajime Togiya, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/893,797

(22) PCT Filed: Apr. 9, 2014

(86) PCT No.: PCT/JP2014/060322
§ 371 (c)(1),
(2) Date: Nov. 24, 2015

(87) PCT Pub. No.: WO2014/199711
PCT Pub. Date: Dec. 18, 2014

(65) Prior Publication Data

US 2016/0101953 A1 Apr. 14, 2016

(30) Foreign Application Priority Data

Jun. 12, 2013 (JP) ..... 2013-124043

(51) Int. Cl.
*B65H 29/14* (2006.01)
*B65H 5/36* (2006.01)
(Continued)

(52) U.S. Cl.
CPC ..... *B65H 5/36* (2013.01); *B65H 3/5215* (2013.01); *B65H 3/68* (2013.01); *B65H 5/062* (2013.01);
(Continued)

(58) Field of Classification Search
CPC ..... B65H 29/12; B65H 29/14; B65H 29/40; B65H 31/00; B65H 2404/1114;
(Continued)

(56) References Cited

U.S. PATENT DOCUMENTS 5,549,292 A * 8/1996 Plain ..... B65H 29/14 271/291
2003/0218293 A1* 11/2003 Mizuno ..... B65H 27/00 271/109
(Continued)

FOREIGN PATENT DOCUMENTS

JP 04-051460 U 4/1992
JP 2006-021861 A 1/2006
JP 5141577 B2 2/2013

*Primary Examiner* — David H Bollinger
(74) *Attorney, Agent, or Firm* — Rabin & Berdo, P.C.

(57) ABSTRACT

The present invention provides a medium protection device and a medium separating and stacking device capable of avoiding damage to a medium when moving the medium along a guide. In a banknote cassette, a guide body is attached to a circumferential side face of a central body of a tongue piece roller in a range not provided with tongue pieces. When feeding out banknotes, the banknote cassette stops the tongue piece roller in a retracted state, thereby positioning an outer circumferential face of the guide body in the vicinity of the surface of a front upper curved portion of a hole in the conveyance guide, such that the hole can be placed in an almost completely blocked state. The present invention can accordingly prevent the vicinity of a corner of a banknote from entering the hole, enabling creasing during conveyance to be forestalled.

10 Claims, 18 Drawing Sheets

(51) Int. Cl.

| | |
|---|---|
| ***B65H 29/12*** | (2006.01) |
| ***B65H 29/52*** | (2006.01) |
| ***B65H 29/70*** | (2006.01) |
| ***B65H 31/10*** | (2006.01) |
| ***B65H 83/02*** | (2006.01) |
| ***G07D 11/00*** | (2006.01) |
| ***B65H 3/52*** | (2006.01) |
| ***B65H 3/68*** | (2006.01) |
| ***B65H 5/06*** | (2006.01) |
| ***B65H 29/22*** | (2006.01) |
| ***B65H 31/36*** | (2006.01) |

(52) U.S. Cl.
CPC ..... *B65H 29/125* (2013.01); *B65H 29/14* (2013.01); *B65H 29/22* (2013.01); *B65H 29/52* (2013.01); *B65H 29/70* (2013.01); *B65H 31/10* (2013.01); *B65H 31/36* (2013.01); *B65H 83/025* (2013.01); *G07D 11/0033* (2013.01); *B65H 2404/1112* (2013.01); *B65H 2404/1113* (2013.01); *B65H 2404/1114* (2013.01); *B65H 2404/1141* (2013.01); *B65H 2404/1313* (2013.01); *B65H 2404/1314* (2013.01); *B65H 2404/1315* (2013.01); *B65H 2404/13161* (2013.01); *B65H 2404/612* (2013.01); *B65H 2701/1912* (2013.01)

(58) Field of Classification Search
CPC ..... B65H 2404/1122; B65H 2404/114; B65H 2404/12; B65H 2404/121
USPC ..... 271/314, 207
See application file for complete search history.

(56) References Cited

U.S. PATENT DOCUMENTS

| | | | | |
|---|---|---|---|---|
| 2004/0135304 | A1* | 7/2004 | Tokunaga | B65H 3/06 271/3.01 |
| 2004/0183249 | A1* | 9/2004 | Sato | B65H 29/001 271/220 |
| 2006/0181020 | A1* | 8/2006 | Numao | B65H 27/00 271/314 |
| 2013/0134669 | A1* | 5/2013 | Dunn | G07F 19/201 271/314 |
| 2014/0265107 | A1* | 9/2014 | Kang | B65H 29/52 271/216 |
| 2015/0371507 | A1* | 12/2015 | Moon | B65H 83/025 271/121 |

* cited by examiner

MEDIUM PROTECTION DEVICE AND MEDIUM SEPARATING AND STACKING DEVICE

TECHNICAL FIELD

The present invention relates to a medium protection device and a medium separating and stacking device. The medium protection device and the medium separating and stacking device of the present invention are preferably applied to, for example, an automatic teller machine (ATM) that internally stores a medium such as banknotes, and performs transaction processing involving banknotes with a customer.

BACKGROUND ART

ATMs hitherto installed in financial institutions, convenience stores and the like are configured to deposit cash such as banknotes and coins for a customer, and to pay out cash to a customer, according to the contents of the transaction with the customer.

ATMs include, for example, a pay-in/pay-out section that exchanges banknotes with the customer, a conveyance section that conveys banknotes, a classification section that classifies inserted banknotes by denomination and authenticity, a temporary holding section that temporarily holds inserted banknotes, banknote cassettes that store banknotes by denomination, and a reject cassette that stores banknotes that are not to be reused.

In a pay-in transaction of the ATM, when a customer inserts banknotes into the pay-in/pay-out section, the inserted banknotes are conveyed to the classification section for classification, and banknotes classified as normal banknotes are stored in the temporary holding section. On the other hand, banknotes determined to be unsuitable for transactions are replaced in the pay-in/pay-out section and returned to the customer.

Then, when the pay-in amount has been confirmed by the customer, the ATM feeds out and reclassifies the denominations of the banknotes stored in the temporary holding section using the classification section, and the banknotes are stored in the respective banknote cassettes according to the classified denomination. Moreover, the ATM stores banknotes that have been determined to be heavily damaged in the reject cassette.

In pay-out processing of the ATM, when the amount to be paid out has been confirmed through operation instruction by the customer, banknotes are fed out from the banknote cassettes according to the amount to be paid out, and are conveyed by the conveyance section. After the classification section has determined that the correct number of normal banknotes have been fed out, the banknotes are conveyed to the pay-in/pay-out section to be taken by the customer.

The banknote cassettes of such ATMs sometimes include a tongue piece roller configured by a central portion that rotates around a predetermined rotation shaft, and flexible tongue pieces provided only in a predetermined range of an outer circumferential face of the central portion, extending in a radiating pattern in a direction away from the central portion (see, for example, Japanese Patent No. 5141577 (FIG. 4, etc.)).

For example, the conventional banknote cassette 817 illustrated in FIG. 17 includes an internal space 21S inside a casing 21, in which banknotes are stacked. The banknote cassette 817 further includes plate shaped conveyance guides 24 and 25 that guide banknotes along a conveyance path 26 for conveying the banknotes to the internal space 21S.

At an upper side and a lower side in the vicinity of a portion where the conveyance path 26 is in communication with the internal space 21S side, feed rollers 32 and separation rollers 35 that rotate about predetermined rotation shafts are disposed facing each other. Picker rollers 42 are disposed at a ceiling face of the internal space 21S.

The banknote cassette 817 further includes tongue piece rollers 36 that share a rotation shaft with the separation rollers 35. As illustrated in FIG. 18, each tongue piece roller 36 is configured by a circular column shaped central body 51 with a smaller external diameter than the separation rollers 35, and tongue pieces 52 provided projecting discretely across a range covering approximately ⅜ of an outer circumferential face of the central body.

The tongue pieces 52 are configured from a flexible material with a high coefficient of friction. Moreover, each tongue piece 52 is formed in a long, narrow, thin plate shape, and an outer end thereof reaches out further than the outer periphery of the separation rollers 35.

The conveyance guides 24 and 25 are appropriately provided with holes that expose a portion of each of the feed rollers 32 and the separation rollers 35, for example, to inside the conveyance path 26, and that allow the feed rollers 32 and the separation rollers 35 to rotate unimpeded. Moreover, as illustrated in FIG. 18, the conveyance guide 25 is provided with holes 25H2 through which the tongue pieces 52 of the tongue piece rollers 36 pass.

During banknote storage by the banknote cassette 817, a banknote conveyed along the conveyance guide 25 is nipped between the feed rollers 32 and the separation rollers 35, and the feed rollers 32 are rotated in the direction of arrow R1, and the separation rollers 35 are rotated in the direction of arrow R2, to discharge the banknote into the internal space 21S. The banknote moves toward the rear inside the internal space 21S, and hits a bill stopper 29 disposed on an extension line of the conveyance path 26, such that the bill stopper 29 absorbs the impact.

The banknote cassette 817 then rotates the tongue piece rollers 36 in the arrow R2 direction together with the separation rollers 35, and pats the banknote inside the internal space 21S downward with the tongue pieces 52 to stack the banknote by pressing the banknote down onto a stage 22 inside the internal space 21S, or onto banknotes stacked thereon, and dragging the banknote toward the front.

When feeding out banknotes, the banknote cassette 817 rotates and stops the tongue pieces 52 of the tongue piece rollers 36 at a retracted position away from the conveyance path 26 and the internal space 21S, and rotates the picker rollers 42 and the feed rollers 32 in the arrow R2 direction.

Moreover, the banknote cassette 817 moves the stage 22 inside the internal space 21S upward, and presses the uppermost face of the stacked banknotes against the picker rollers 42. One note at a time, the banknote with the uppermost face out of the stacked banknotes is separated and fed out to the conveyance path 26 by the rotating picker rollers 42 and feed rollers 32.

Namely, the banknote cassette 817 is capable of stacking and storing banknotes inside the internal space 21S, and of separating and feeding out banknotes from inside the internal space 21S.

SUMMARY OF INVENTION

Technical Problem

However, when feeding out banknotes in the thus configured banknote cassette 817, the tongue pieces 52 of the tongue piece rollers 36 are rotated to and stopped at the retracted position away from the conveyance path 26 and the internal space 21S. Accordingly, as illustrated in FIG. 18, the holes 25H2 of the conveyance guide 25 are placed in a wide open state.

As they circulate in the market, for example, banknotes sometimes lose rigidity, for example due to being folded during handling. In the banknote cassette 817, sometimes, when feeding out banknotes with poor rigidity, the banknotes pass the vicinity of the holes 25H2 of the conveyance guide 25 in a state in which there is heavy drooping in the vicinity of corner portions.

Moreover, in the banknote cassette 817, banknotes inside the conveyance path 26 are preferably conveyed with their short edges aligned parallel to the direction of progress. However, if, for whatever reason, a banknote is at an angle, referred to as traveling skewed, sometimes the corners of the banknote pass the vicinity of the holes 25H2 of the conveyance guide 25.

In such cases in the banknote cassette 817, the corners of the banknote are pushed onward in a state in which they are caught on side edge portions of the holes 25H2. The banknote therefore becomes creased, for example at the ends of the holes, which can lead to damage of the banknote.

The present invention provides a medium protection device and a medium separating and stacking device capable of avoiding damage to a medium when moving the medium along a guide.

Solution to Problem

A first aspect of the present invention is a medium protection device including: a conveyance guide forming a conveyance path of a paper sheet shaped medium; a central shaft that is substantially orthogonal to a direction of progress of the medium along the conveyance path, that is substantially parallel to a face of the medium conveyed on the conveyance path, and that is separated by a predetermined distance from a location on the conveyance guide furthest to the conveyance path side; a tongue piece roller including a central body that has a radius from the central shaft of less than the predetermined distance and that rotates about the central shaft, and flexible tongue pieces that are provided discretely projecting out from the central body within a predetermined provision range of an outer circumferential portion centered on the central shaft; a through hole formed in the conveyance guide at a portion through which the tongue pieces pass during rotation of the central body about the central shaft; and a guide body that is provided in a non-provision range excluding the provision range of the outer circumferential portion of the central body centered on the central shaft, and that is positioned further outward than the outer circumferential portion.

Accordingly, the first aspect of the present invention is capable of patting the medium with the tongue piece when the tongue piece roller is rotated together with the central shaft. On the other hand, in the first aspect of the present invention, when the tongue piece roller is stopped in a state in which the tongue piece is not exposed to the conveyance path, the guide body can be positioned so as to block off the through hole in the conveyance guide. Accordingly, the first aspect of the present invention is capable of preventing a portion of the medium that is moving along the conveyance path from entering the through hole in the conveyance guide and sustaining damage.

A second aspect of the present invention is a medium separating and stacking device including: a space in which a paper sheet shaped medium is stacked; a conveyance guide that is in communication with the space and that forms a conveyance path of the medium; a central shaft that is substantially orthogonal to a direction of progress of the medium along the conveyance path, that is substantially parallel to a face of the medium conveyed on the conveyance path, and that is separated by a predetermined distance from a location on the conveyance guide furthest to the conveyance path side; a tongue piece roller including a central body that has a radius from the central shaft of less than the predetermined distance and that rotates about the central shaft, and one, or two or more, flexible tongue pieces that are provided projecting out from the central body within a predetermined provision range of an outer circumferential portion centered on the central shaft; a through hole formed in the conveyance guide at a portion through which the tongue pieces pass during rotation of the central body about the central shaft; and a guide body that is provided in a non-provision range excluding the provision range of the outer circumferential portion of the central body centered on the central shaft, and that is positioned further outward than the outer circumferential portion.

In the second aspect of the present invention, when moving the medium along the conveyance path in the direction of progress to be discharged into the space, the tongue piece is capable of patting and stacking the medium when the tongue piece roller is rotated together with the central shaft. On the other hand, in the second aspect of the present invention, when moving the medium that was in the space in the opposite direction along the conveyance path, when the tongue piece roller is stopped in a state in which the tongue piece is not exposed to the conveyance path, the guide body can be positioned so as to block off the through hole in the conveyance guide. Accordingly, the second aspect of the present invention is capable of preventing a portion of the medium moving along the conveyance path from entering the through hole in the conveyance guide and sustaining damage.

Advantageous Effects of Invention

The above aspects of the present invention are capable of providing a medium protection device and a medium separating and stacking device capable of avoiding damage to the medium when moving the medium along a guide.

DESCRIPTION OF EMBODIMENTS

Explanation follows regarding embodiments for implementing the invention (referred to below as exemplary embodiments), with reference to the drawings.

1. First Exemplary Embodiment 1-1. Overall Configuration of ATM

Figure 1:
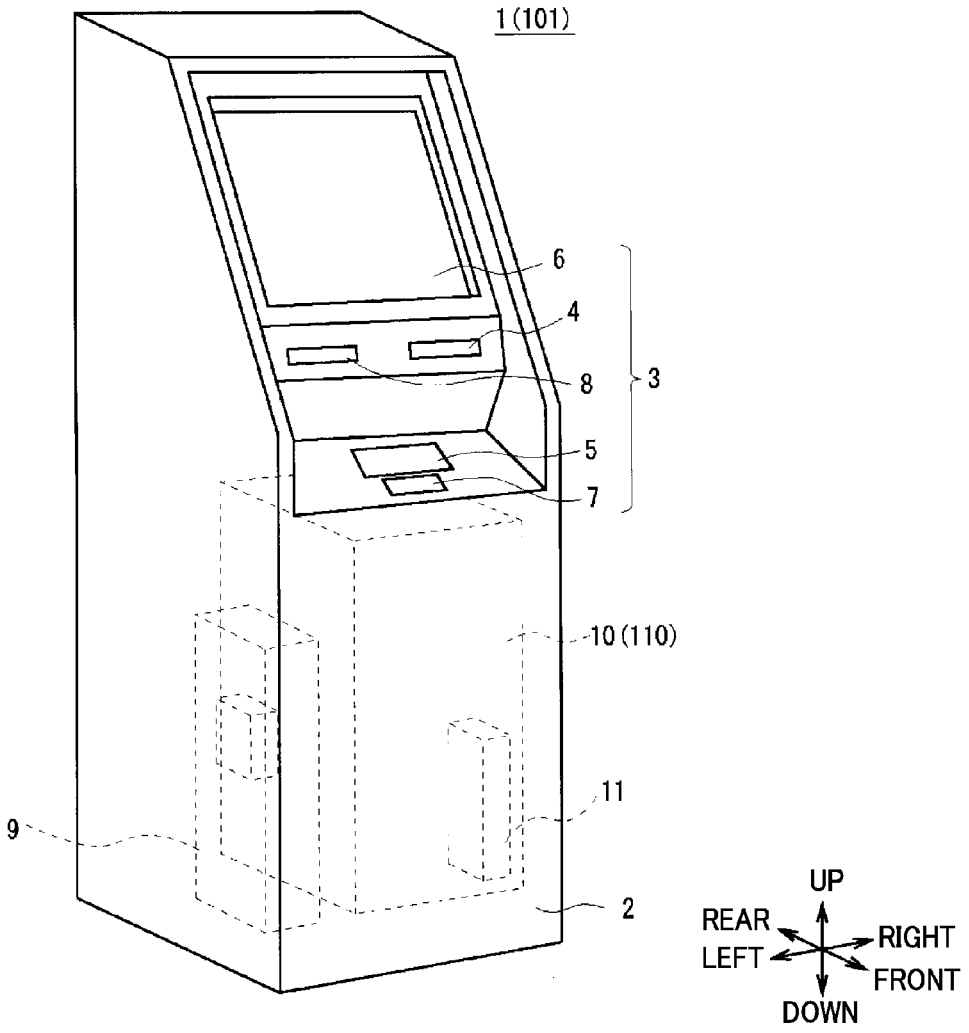
FIG. 1 is a schematic perspective view illustrating a configuration of an ATM.

As illustrated in the external view of FIG. 1, an ATM 1 is configured around box-shaped casing 2, and is, for example, installed in a financial institution to perform cash transactions such as deposit transactions and withdrawal transactions with a customer.

The casing 2 is configured with a diagonally cut-away shape at a location enabling easy insertion of banknotes BL and easy operation of a touch panel by a customer facing the front side of the casing 2, namely at a portion spanning from a front face upper portion to the top face, with a customer interface 3 provided at this portion.

The customer interface 3 performs cash and passbook interactions with a customer directly, and also notifies transaction-related information and receives operation instructions. The customer interface 3 is provided with a card insertion/removal port 4, a pay-in/pay-out port 5, an operation and display section 6, a ten-key 7, and a receipt issue port 8.

The card insertion/removal port 4 is a section for insertion and return of various cards, such as cash cards. A card processor (not illustrated in the drawings) that reads, for example, account numbers that are magnetically recorded on the various cards is provided behind the card insertion/removal port 4.

The pay-in/pay-out port 5 is a section into which banknotes BL for paying in are inserted by a customer, and where banknotes BL for paying out to a customer are dispensed. The pay-in/pay-out port 5 is moreover opened up, or closed off, by driving a shutter. Note that banknotes BL are, for example, configured by rectangular shaped paper.

The operation and display section 6 is a touch panel integrated with a Liquid Crystal Display (LCD) that displays operation screens during transactions, and a touch sensor that is input with, for example, a transaction type selection, a PIN, and a transaction amount.

The ten-key 7 is a physical keypad that receives input of the numbers 0 to 9, for example. The ten-key 7 is employed during PIN and transaction amount input operations, for example.

The receipt issue port 8 is a section that issues a receipt printed with transaction details, etc. at the end of transaction processing. A receipt processor (not illustrated in the drawings) that prints transaction details on the receipt, etc. is provided behind the receipt issue port 8.

In the following explanation of the ATM 1, the front side is defined as the side facing a customer, and the opposite side thereto is defined as the rear side. The left side, right side, upper side and lower side are defined from the perspective of the left and right as seen by a customer facing the front side.

A main controller 9 that performs integrated control of the overall automated teller machine 1, and a banknote pay-in/pay-out device 10 that performs various processing relating to banknotes, etc. are provided inside the casing 2.

The main controller 9 is configured around a Central Processing Unit (CPU) (not illustrated in the drawings). The main controller 9 reads and executes predetermined programs from, for example, Read Only Memory (ROM) (not illustrated in the drawings) or flash memory, to perform various processing in pay-in transactions and pay-out transactions, etc.

Inside the main controller 9 is a memory section configured by, for example, Random Access Memory (RAM), a hard disk drive, and flash memory. The main controller 9 records various data in the memory section.

Openable-and-closable doors, for example, configure portions of side faces, such as on the front face side or rear face side of the casing 2. Namely, as illustrated in FIG. 1, during cash transaction operations with customers, the respective doors are closed such that the banknotes BL stored inside the banknote pay-in/pay-out device 10 are protected by the casing 2. On the other hand, during a maintenance operation performed by an operator, the respective doors of the casing 2 are opened as required, enabling easy completion of tasks on each internal portion.

Figure 2:
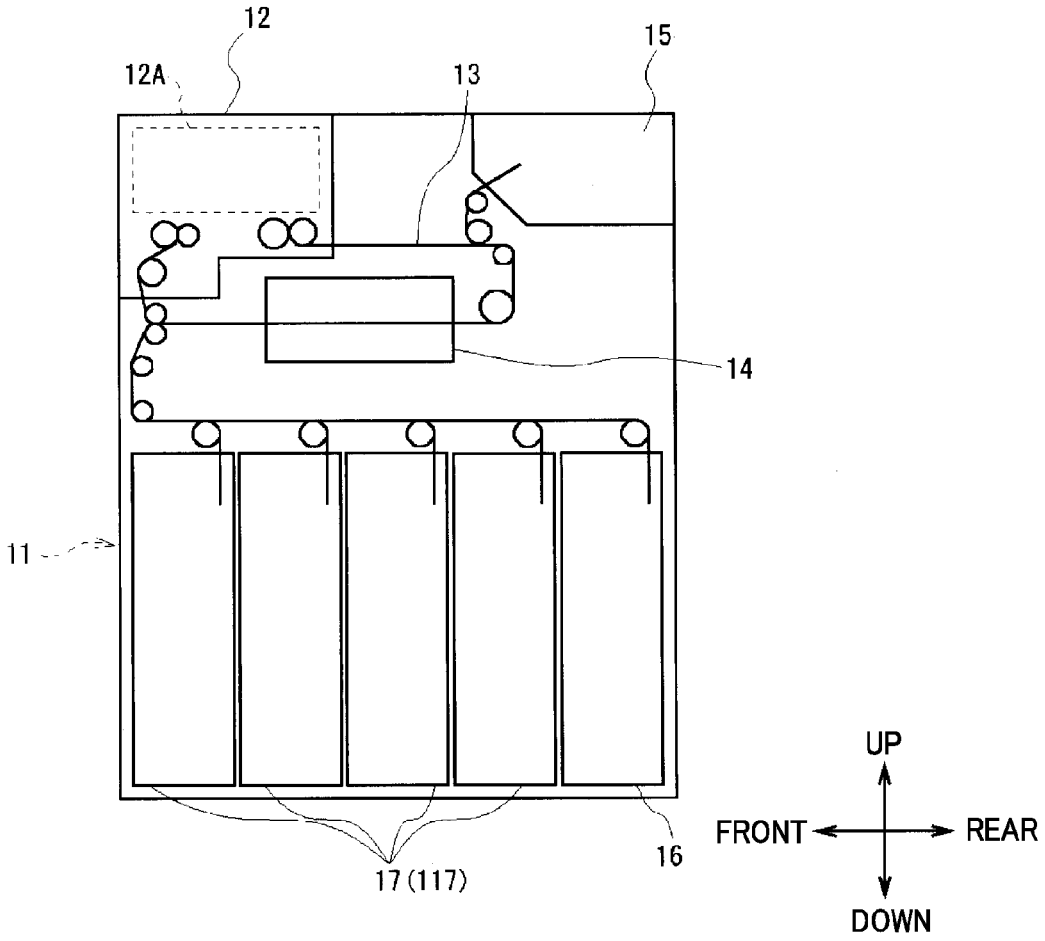
FIG. 2 is a schematic view illustrating a configuration of a banknote pay-in/pay-out device.

As illustrated in the side view of FIG. 2, the banknote pay-in/pay-out device 10 is configured by a combination of plural internal sections that perform various processing relating to banknotes. Each section of the banknote pay-in/pay-out device 10 is controlled by a banknote controller 11.

The banknote controller 11 is configured around a CPU (not illustrated in the drawings), similarly to the main controller 9. The banknote controller 11 reads and executes predetermined programs from, such as from ROM (not illustrated in the drawings) or flash memory, in order to perform various processing, such as processing to decide a banknote conveyance destination.

Inside the banknote controller 11 is a memory section configured by, for example, RAM and flash memory. The banknote controller 11 records various data in the memory section.

For example, in a pay-in transaction in which a customer pays in banknotes, after receiving predetermined operation input through the operation and display section 6 (FIG. 1), the banknote controller 11 opens the shutter to allow a customer to insert banknotes into a holding space 12A formed inside a pay-in/pay-out section 12.

When the banknotes BL have been inserted into the holding space 12A, the pay-in/pay-out section 12 closes the shutter and feeds the banknotes out of the holding space 12A one note at a time, passing the banknotes to a conveyance section 13. The conveyance section 13 is configured by plural rollers and belts, etc. and conveys the banknotes, configured by rectangular shaped sheets of paper, to a classification section 14, with the short edge direction of the rectangular banknotes running along the direction of travel.

As the banknotes are being conveyed inside the classification section 14, optical devices and/or magnetic detection devices, for example, classify the banknotes, such as according to denomination, authenticity, and degree of wear. The classification section 14 moreover notifies banknote classification results to the banknote controller 11. The banknote controller 11 decides the conveyance destination of a banknote based on the acquired classification results.

Once the conveyance destination of a banknote has been decided, the conveyance section 13, for example, conveys banknotes that the classification section 14 has classified as normal banknotes to a temporary holding section 15 where they are temporarily held. The conveyance section 13 also conveys reject banknotes, classified as unsuitable for transaction use, to the pay-in/pay-out section 12 to be returned to the customer.

Next, the banknote controller 11 prompts the customer to approve the pay-in amount using the operation and display section 6, and the conveyance section 13 conveys the banknotes held in the temporary holding section 15 to the classification section 14. The banknote controller 11 prompts the classification section 14 to classify the banknotes according to, for example, denomination and degree of wear, and acquires the classification results.

The banknote controller 11 uses the conveyance section 13 to convey banknotes with heavy wear for storage in a reject cassette 16 as banknotes that are not to be reused. On the other hand, the banknote controller 11 uses the conveyance section 13 to convey banknotes with light wear to be stored by denomination in banknote cassettes 17 as reusable banknotes.

In a pay-out transaction in which a customer withdraws banknotes, for example, after receiving predetermined operation input through the operation and display section 6 (FIG. 1), the banknote controller 11 feeds out banknotes making up the amount to be paid out from the banknote cassettes 17, and conveys the banknotes to the classification section 14 using the conveyance section 13.

The banknote controller 11 then classifies the banknotes in the classification section 14, before conveying the banknotes to the pay-in/pay-out section 12 using the conveyance section 13 and stacking the banknotes in the holding space 12A, and opening the shutter of the pay-in/pay-out port 5 (FIG. 1) to allow removal by the customer.

The banknote cassettes 17 accordingly accept and internally store banknotes BL conveyed by the conveyance section 13, and feed out and pass to the conveyance section 13 banknotes BL from the interior.

1-2. Banknote Cassette Configuration

Figure 3:
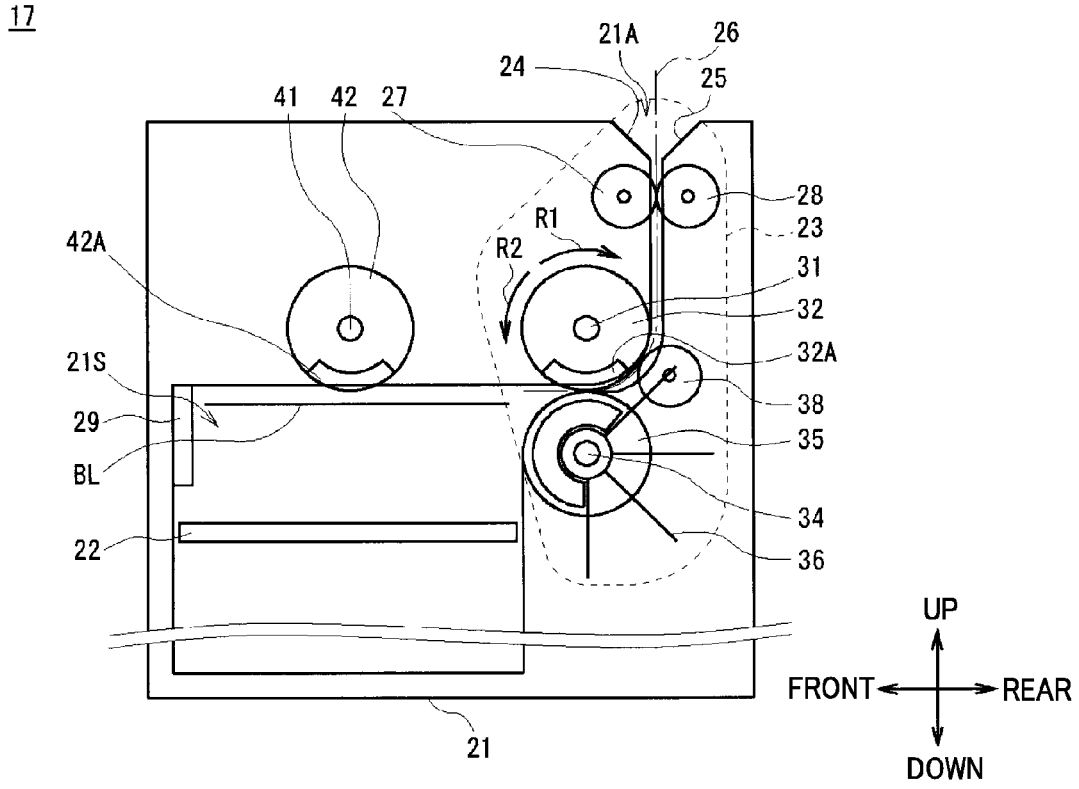
FIG. 3 is a schematic view illustrating a configuration of a banknote cassette.

As schematically illustrated in FIG. 3, the banknote cassettes 17 store banknotes BL, serving as a medium, inside rectangular block shaped casing 21. Note that FIG. 3 is a side view as viewed from the right. For ease of explanation, some components are see-through, or have been omitted.

The casing 21 is substantially closed off at each of the front and rear, left and right, and upper and lower side faces, thereby protecting the stacked banknotes BL and the respective components inside. A cuboid internal space 21S is formed inside the casing 21.

A flat plate shaped stage 22 is provided inside the internal space 21S. The plate face of the stage 22 is oriented substantially horizontally, and the banknotes BL are stacked on an upper face thereof. The stage 22 is moved in an vertical direction by a stage drive mechanism (not illustrated in the drawings).

An uppermost face sensor (not illustrated in the drawings) is provided at a predetermined location of the casing 21 to detect the vertical direction position of the upper face of the stage 22, or of the uppermost face of the stacked banknotes BL (referred to as the stage uppermost face hereafter). The uppermost face sensor detects the position of the stage uppermost face, and outputs detection results to the banknote controller 11.

A long, thin, slit shaped hole 21A extending along the left-right direction is provided at a rear portion of an upper face of the casing 21. An internal cassette conveyance section 23 for conveying banknotes BL is provided between the hole 21A and the internal space 21S, at a portion toward the rear of the upper side of the casing 21.

The internal cassette conveyance section 23 is formed with a conveyance path 26 interposed between conveyance guides 24 and 25. The conveyance path 26 progresses downward from the hole 21A of the casing 21, and curves toward the front before coming into communication with a rear end of an upper portion of the internal space 21S.

The conveyance guide 24 has a shape configured by a lower side portion of a plate shaped member disposed with its plate face facing in the front-rear direction and curving appropriately toward the front, following the conveyance path 26. The conveyance guide 24 continues toward the front from one end of the conveyance path 26 at the front lower side to configure a ceiling face of the internal space 21S.

The conveyance guide 25 has a shape curving in a crank shape at an intermediate portion of a plate shaped member disposed with its plate face facing in the front-rear direction. An upper side portion of the conveyance guide 25 configures a rear face to a lower face of the conveyance path 26, and a lower side portion of the conveyance guide 25 configures a rear side face of the internal space 21S.

Figure 5A:
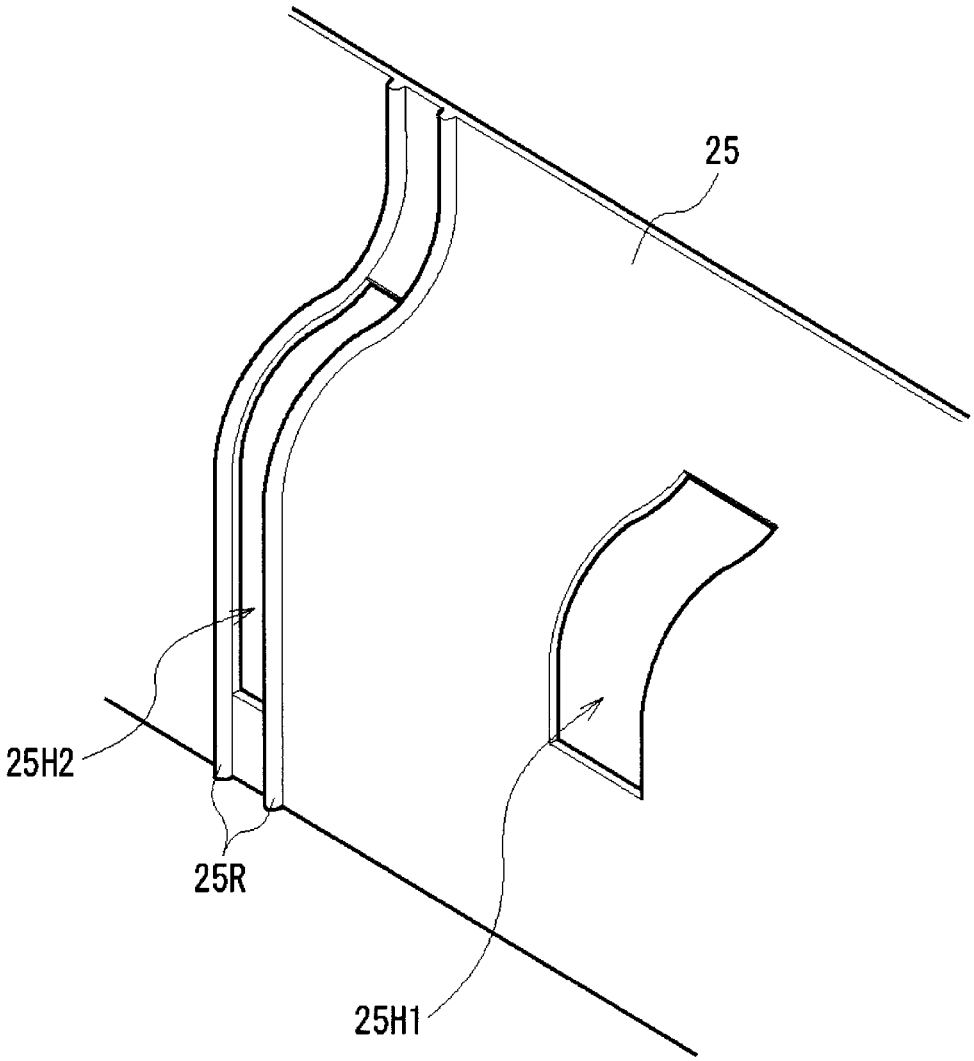
FIG. 5A is a schematic perspective view illustrating a configuration of a conveyance guide.

As illustrated in FIG. 5A, a front face on the conveyance path 26 side of the conveyance guide 25 is provided with plural ribs 25R that project up further than their surroundings, and that run along the conveyance direction of banknotes along the conveyance path 26.

Conveyance rollers 27 and 28 are provided directly below the hole 21A in the casing 21, so as to sandwich the conveyance path 26 from the front and rear.

The conveyance roller 27 is formed in a flattened circular disk shape, and has a central shaft oriented along the left-right direction. The central shaft is positioned further to the front than the conveyance guide 24, and an outer circumferential face of the conveyance roller 27 is partially exposed on the conveyance path 26 side through an appropriately formed hole in the conveyance guide 24.

The conveyance roller 27 rotates in an arrow R1 direction, this being the clockwise direction in FIG. 3, or in an arrow R2 direction, this being the opposite direction thereto, under drive force transmitted from an actuator (not illustrated in the drawings).

Similarly to the conveyance roller 27, the conveyance roller 28 is formed in a flattened circular disk shape, has a central shaft oriented along the left-right direction, and rotates freely in the arrow R1 direction or the arrow R2 direction.

The conveyance roller 28 is provided at a position facing the conveyance roller 27 across the conveyance path 26, with its central shaft positioned further to the rear than the conveyance guide 25. An outer circumferential face of the conveyance roller 28 is partially exposed on the conveyance path 26 side through an appropriately formed hole in the conveyance guide 25. The conveyance roller 28 is biased toward the front by a spring (not illustrated in the drawings).

The conveyance roller 28 presses a banknote BL being conveyed along the conveyance path 26 against the conveyance roller 27, and the drive force of the conveyance roller 27 is transmitted to the banknote BL, thereby moving the banknote BL upward or downward along the conveyance path 26.

Plural rollers or the like are disposed on both sides of the conveyance path 26 in the vicinity of a front lower side end portion of the conveyance path 26, namely in the vicinity of a connection location between the conveyance path 26 and the internal space 21S.

A portion of the upper side of the conveyance path 26 is configured around a long, thin, circular column shaped central shaft 31 running along the left-right direction. The central shaft 31 is provided at a location at the upper side of the conveyance guide 24 in the vicinity of a terminal end of the conveyance path 26, and is separated by a predetermined distance from a lower face of the conveyance guide 24.

The central shaft 31 is supported by a support portion (not illustrated in the drawings) so as to be capable of rotating in both the arrow R1 direction and the arrow R2 direction. Drive force from an actuator (not illustrated in the drawings) is transmitted to the central shaft 31 through gears (not illustrated in the drawings) under control of the banknote controller 11 (FIG. 2).

Figure 4:
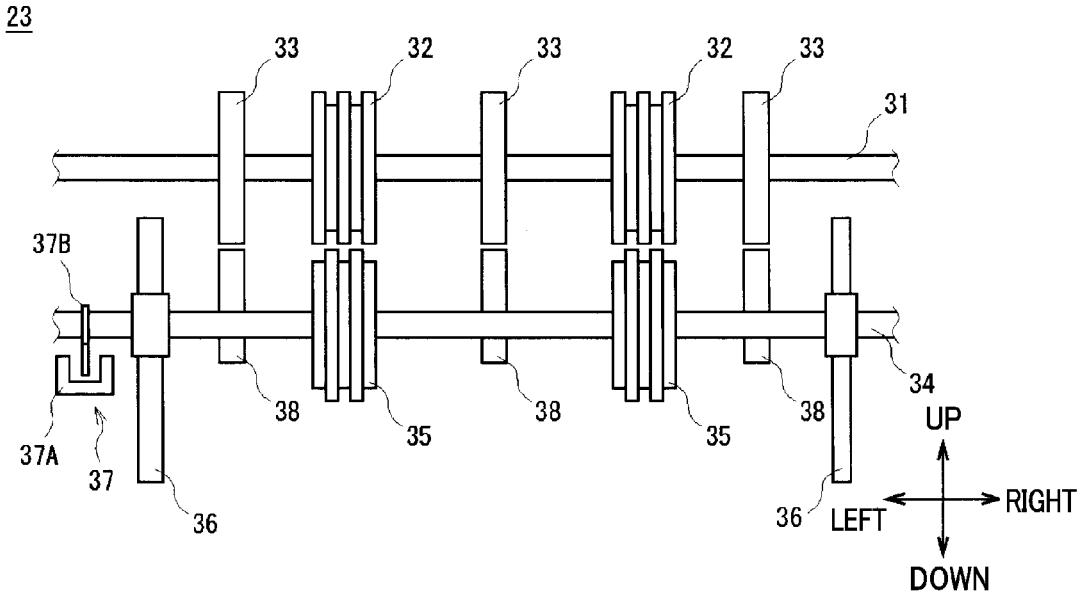
FIG. 4 is a schematic view illustrating a configuration of an internal cassette conveyance section.

As illustrated in FIG. 4, two feed rollers 32 and three conveyance rollers 33 are alternately fitted onto the central shaft 31 at intervals to each other.

The feed rollers 32 are circular column shaped, and have a predetermined radius and a predetermined thickness. Two grooves are provided running around a circumferential side face of each of the feed rollers 32 in the circumferential direction.

The feed rollers 32 are configured by a resin material with a comparatively low coefficient of friction. The surface of ridge portions where the grooves are not present has a smooth finish, and hardly any frictional force arises against the banknotes BL, which slide easily thereacross. A high friction portion 32A with an increased coefficient of friction is attached to a portion of the circumferential side face of each of the feed rollers 32.

The conveyance rollers 33 are formed in flattened circular disk shapes, and have substantially the same external diameter as the feed rollers 32, and a thinner thickness in the left-right direction than the feed rollers 32.

Predetermined holes are formed directly below the respective feed rollers 32 and conveyance rollers 33 in the conveyance guide 24. The circumferential side faces of the feed rollers 32 and the conveyance rollers 33 are partially exposed to the conveyance path 26 side through the holes.

A portion of the lower side of the conveyance path 26 is configured around a long, thin circular column shaped central shaft 34 running along the left-right direction. The central shaft 34 is provided at a location at the lower side of the conveyance guide 25 in the vicinity of the terminal end of the conveyance path 26, is substantially directly below the central shaft 31, and is separated by a predetermined distance from an upper face of the conveyance guide 25.

Similarly to the central shaft 31, the central shaft 34 is supported by a support portion so as to be capable of rotating in both the arrow R1 direction and the arrow R2 direction. Again, similarly to in the central shaft 31, drive force from an actuator (not illustrated in the drawings) is transmitted to the central shaft 34 through gears (not illustrated in the drawings) under control of the banknote controller 11 (FIG. 2).

As illustrated in FIG. 4, separation rollers 35 are fitted onto the central shaft 34 at locations respectively corresponding to the two feed rollers 32, and tongue piece rollers 36 are fitted onto the central shaft 34 at locations separated to the outside of the separation rollers 35.

The separation rollers 35 are circular column shaped and have substantially the same radius and thickness as the feed rollers 32. Two ridge portions are provided running around a circumferential side face of each separation roller 35 in the circumferential direction at locations facing the respective grooves of the feed rollers 32.

Similarly to the feed rollers 32, the separation rollers 35 are configured by a resin material with a comparatively low coefficient of friction, and the surface of the ridge portions has a smooth finish, and hardly any frictional force arises against the banknotes BL, which slide easily thereacross.

Each of the separation rollers 35 is attached to the central shaft 34 through a rotation direction control mechanism 35B and a bearing 35C. The rotation direction of the rotation direction control mechanism 35B is restricted to a single direction, such that it is capable of allowing the separation roller 35 to rotate freely in the arrow R2 direction with respect to the central shaft 34, but does not allow the separation roller 35 to rotate in the arrow R1 direction.

Figure 5B:
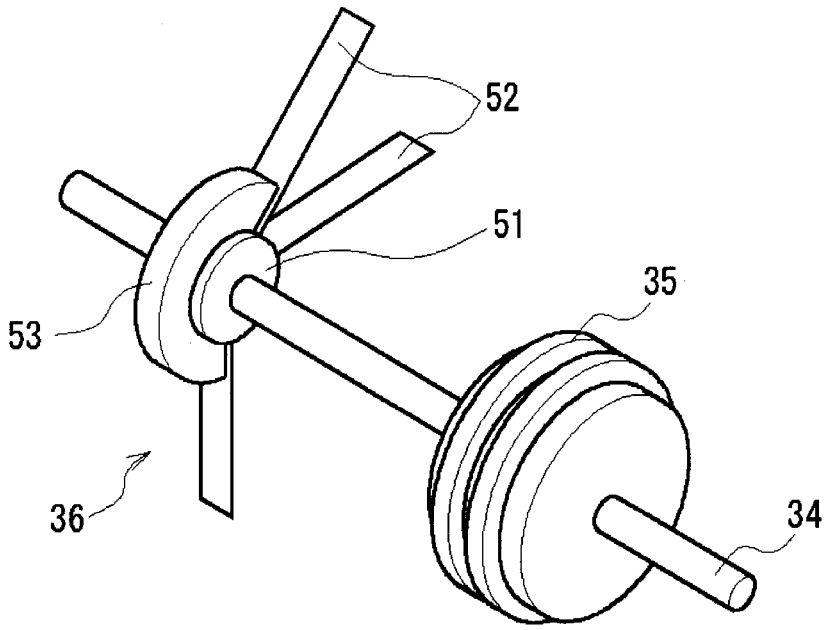
FIG. 5B is a schematic perspective view illustrating configuration of a tongue piece roller and a separation roller.
Figure 6A:
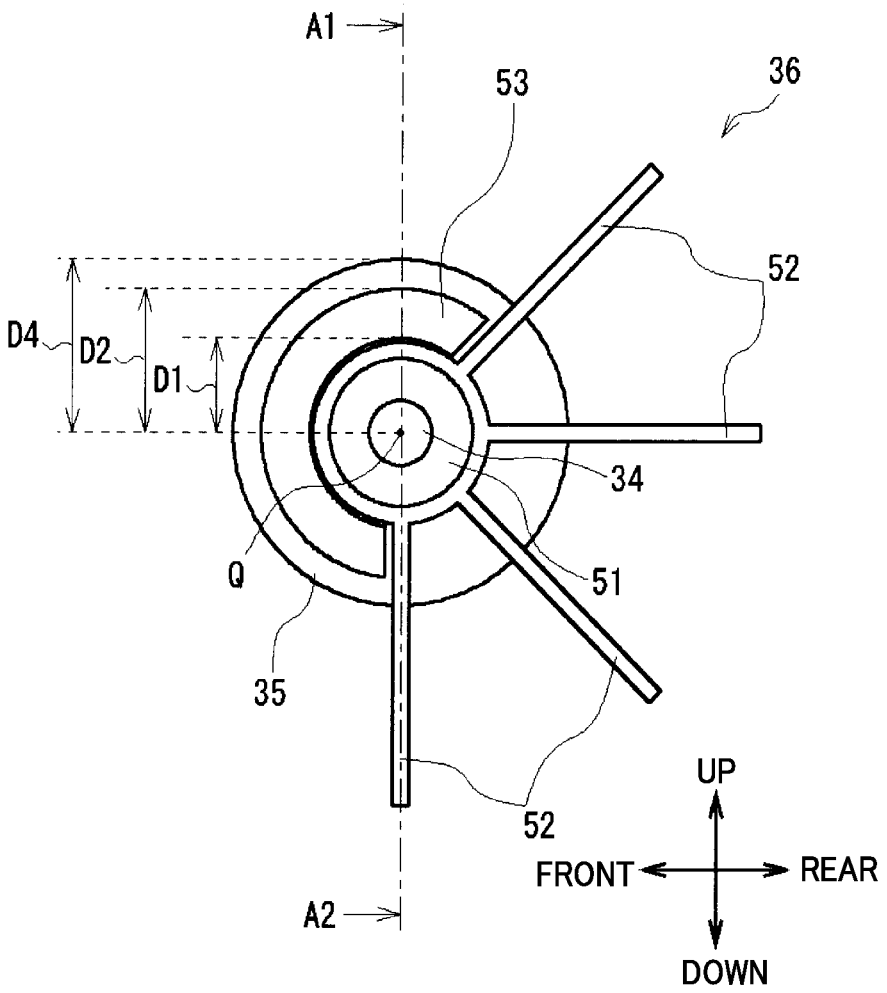
FIG. 6A is a schematic view illustrating configuration of a tongue piece roller and a separation roller according to a first exemplary embodiment.
Figure 6B:
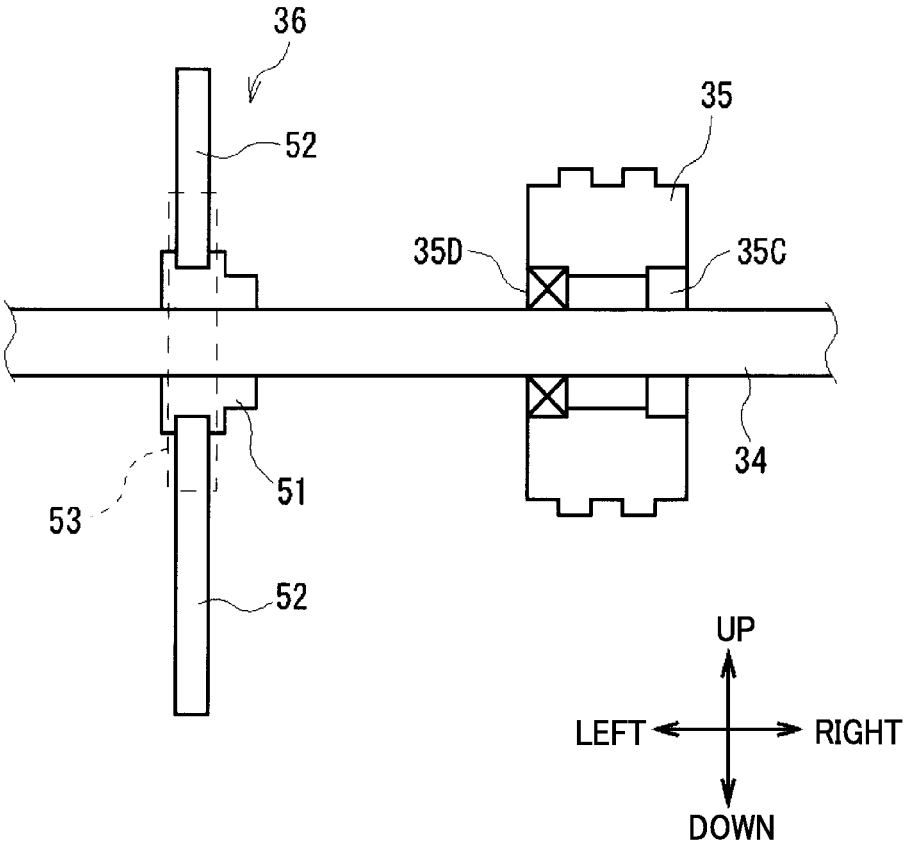
FIG. 6B is a schematic view illustrating configuration of a tongue piece roller and a separation roller according to the first exemplary embodiment.

As illustrated in FIG. 5B, FIG. 6A, and FIG. 6B, each tongue piece roller 36 is configured by a central body 51, tongue pieces 52, and a guide body 53. FIG. 6A is a side view from the left, and FIG. 6B is a cross-section taken along A1-A2 in FIG. 6A.

The central body 51 is formed in a circular column shape with a smaller radius than those of the separation rollers 35, and is fitted onto the central shaft 34. A circumferential side face of the central body 51 is provided with four of the tongue pieces 52 discretely over a range of approximately 135°. The tongue pieces 52 have long, thin plate shapes extending radially outward from the central shaft 34 side, and are configured from a material such as a flexible resin or rubber.

Note that the four tongue pieces 52 are integrally formed to a circular ring portion encircling the outside of the central body 51. The circular ring portion is fitted around the outer periphery of the central body 51 to attach it to the central body 51. As illustrated in FIG. 6A, the radius D1 of the central body 51 including the circular ring portion is sufficiently smaller than the radius D4 of the separation rollers 35.

The guide body 53 is configured in a shape covering the outside of the central body 51 over a range of approximately 225° where the tongue pieces 52 are not provided to the circumferential side face of the central body 51.

From another perspective, the guide body 53 has a shape of a circular ring shaped member from which a range of approximately 135°, this being the range where the tongue pieces 52 are provided to the central body 51, has been removed, so as to give a shape substantially resembling the letter C, or an appropriately rotated form thereof, as viewed along the left-right direction.

In an attached state of the guide body 53 to the central body 51, the apparent radius D2 from the center Q of the central shaft 34 is slightly smaller than the radius D4 of the separation rollers 35. An outer circumferential face of the guide body 53 has a smooth finish.

In other words, the guide body 53 is attached to the central body 51, such that the apparent radius D1 of the central body 51 is enlarged to the radius D2 across a range of approximately 225° where the tongue pieces 52 are not provided.

The tongue piece rollers 36 are provided with the guide body 53 in addition to the conventional-type central body 51 and tongue pieces 52.

The central shaft 34 is provided with a direction detection sensor 37. The direction detection sensor 37 is configured by a light emitting and receiving portion 37A attached and fixed on the casing 21 side, and a light blocking portion 37B that is attached to the central shaft 34 and rotates together with the central shaft 34.

The light emitting and receiving portion 37A is formed substantially in a U-shape as viewed along the front-rear direction. A light emitting device that emits a predetermined detection light toward the right under control of the banknote controller 11 (FIG. 2) is built into a left side portion of the light emitting and receiving portion 37A. A light receiving device that receives the detection light and notifies the banknote controller 11 of a light detection result is built into a right side portion of the light emitting and receiving portion 37A.

The light blocking portion 37B extends outward only across a comparatively narrow angle range around the circumferential direction of the central shaft 34 (for example approximately 10°). The light blocking portion 37B blocks the detection light only when it is positioned between the light emitting device and the light receiving device of the light emitting and receiving portion 37A.

In this configuration, when the central shaft 34 is oriented in a predetermined direction, the light blocking portion 37B blocks the detection light emitted from the light emitting device of the light emitting and receiving portion 37A, and the direction detection sensor 37 notifies the banknote controller 11 of this fact. When the central shaft 34 is oriented in other directions, the detection light emitted by the light emitting device of the light emitting and receiving portion 37A is received by the light receiving device, and the direction detection sensor 37 notifies the banknote controller 11 of this fact.

The banknote controller 11 can accordingly identify whether or not the central shaft 34 is oriented in the predetermined direction based on the notification from the direction detection sensor 37.

In the internal cassette conveyance section 23, three tension rollers 38 are provided at respective positions facing the three conveyance rollers 33 at the lower side and rear of the conveyance path 26, and at the rear side of and slightly above the separation rollers 35 (FIG. 3, FIG. 4).

The tension rollers 38 are configured in flattened circular disk shapes with a smaller radius than those of, and substantially the same thickness in the left-right direction as, the conveyance rollers 33. The tension rollers 38 rotate freely around a different shaft (not illustrated in the drawings) to the central shaft 34. The tension rollers 38 are biased against the conveyance rollers 33 by a spring (not illustrated in the drawings).

As illustrated in FIG. 5A, the conveyance guide 25 is formed with holes 25H1 above and in front of the separation rollers 35. The conveyance guide 25 is also formed with holes 25H2, serving as through holes, above and in front of the tongue piece rollers 36. Note that the conveyance guide 25 is also formed with predetermined holes (not illustrated in the drawings) above and in front of the tension rollers 38.

A portion of the conveyance guide 25 in the vicinity of the terminal end of the conveyance path 26, namely a portion in the vicinity of the upper end of the rear side face of the internal space 21S, is curved in a circular arc shape with a slightly smaller radius than the outer circumferential faces of the separation rollers 35. For example, a radius D3 of the curved portion from the center Q of the central shaft 34 to a ridge line 25RE of the ribs 25R is slightly smaller than the radius D4 of the separation rollers 35. In other words, the conveyance guide 25 is curved so as to protrude out toward the opposite side to the central shaft 34.

Figure 7A:
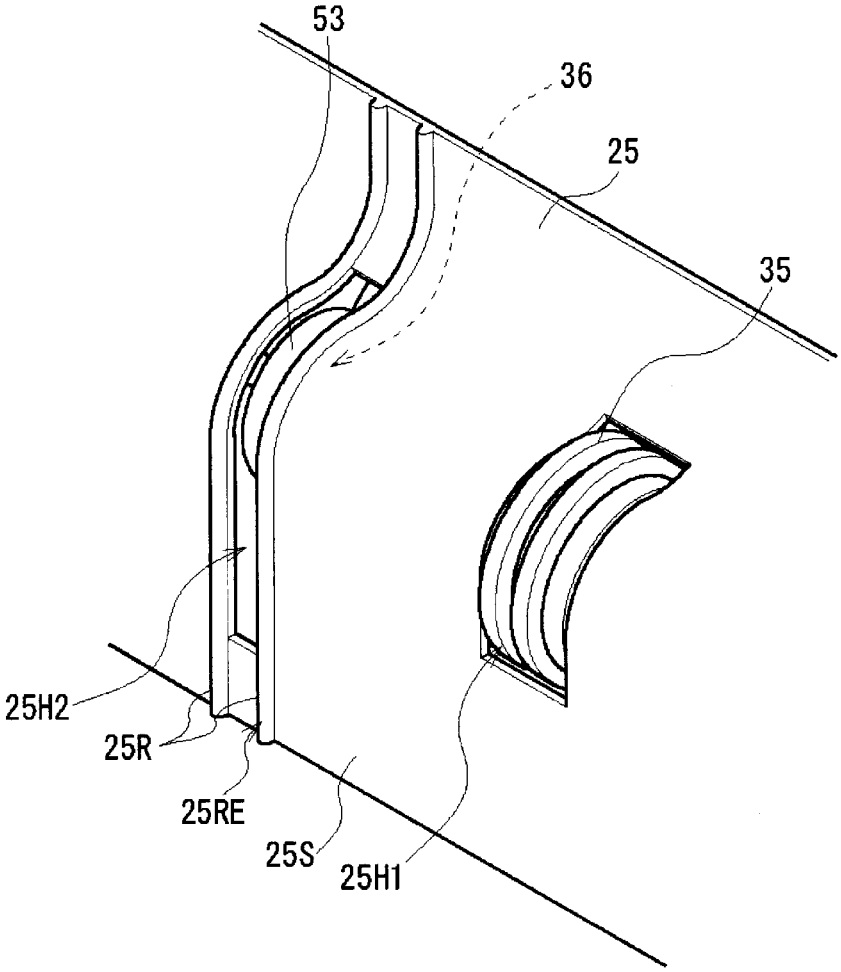
FIG. 7A is a schematic view illustrating a relationship between a conveyance guide and a guide body.

In the thus configured banknote cassette 17, as illustrated in FIG. 7A that corresponds to FIG. 5A and FIG. 5B, a portion of each of the separation rollers 35 spanning from the upper side to the front side of the outer circumferential face is exposed on the conveyance path 26 side through the holes 25H1.

Figure 7B:
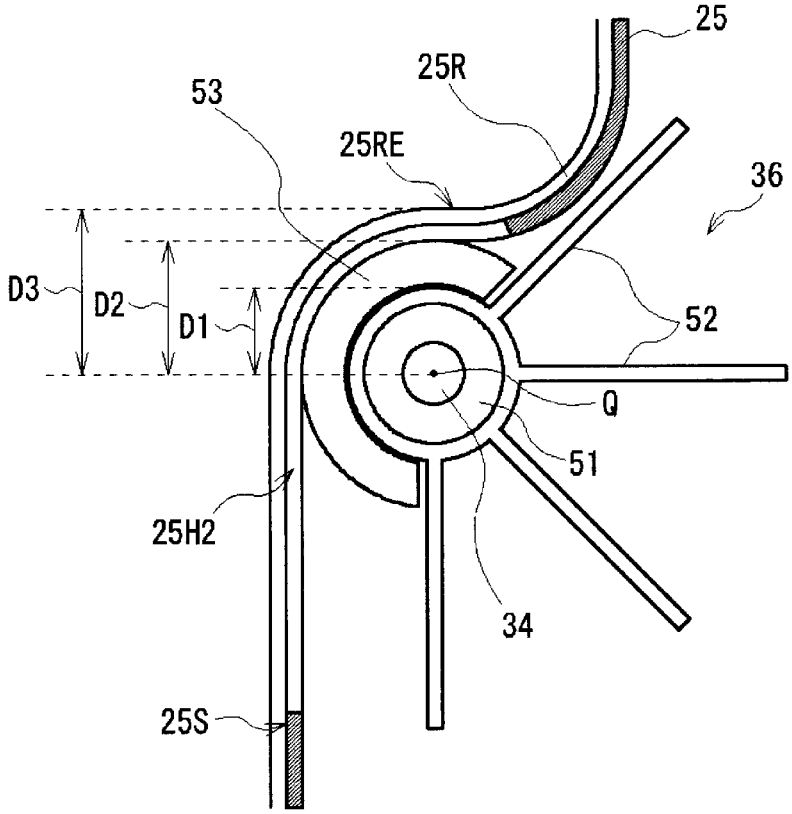
FIG. 7B is a schematic view illustrating a relationship between a conveyance guide and a guide body.

In the banknote cassette 17, as illustrated in the cross-section of FIG. 7B, the central body 51 of each tongue piece roller 36 is at a separation from the ridge lines 25RE of the ribs 25R and a surface 25S of the conveyance guide 25. If the radii centered on the center Q of the central shaft 34 are compared, the radius D1 of the central body 51 is sufficiently smaller than the radius D3 of the conveyance guide 25.

However, as illustrated in FIG. 7B, in the tongue piece rollers 36, when all of the tongue pieces 52 are positioned to the rear of or below the conveyance guide 25 due to rotation of the central shaft 34, a portion of the guide body 53 can be disposed above and in front of the central body 51.

At this time the tongue piece rollers 36 can place the holes 25H2 in an almost completely blocked state due to positioning the outer circumferential face of the guide body 53 in the vicinity of the surface 25S, predeterminedly slightly below and to the rear of the surface 25S, at front upper curved portions of the holes 25H2 of the conveyance guide 25.

If the radii centered on the center Q of the central shaft 34 are compared, at this time, the front upper portion of the tongue piece roller 36 has the radius D2 due to the guide body 53, this being a value fairly close to that of the radius D3 of the conveyance guide 25.

In the following explanation, a state in which the tongue pieces 52 of the tongue piece rollers 36 are oriented in a range spanning from below to the upper rear of the central shaft 34, and are retracted below and to the rear of the conveyance guide 25 and not exposed to the conveyance path 26 and the internal space 21S (FIG. 7A, FIG. 7B), is referred to as a retracted state of the tongue piece rollers 36.

Further, the attachment direction of the direction detection sensor 37 described above is calibrated such that the detection light emitted from the light emitting device of the light emitting and receiving portion 37A is blocked by the light blocking portion 37B when the tongue piece rollers 36 are in the retracted state.

The banknote controller 11 (FIG. 2) is accordingly capable of identifying whether or not the tongue piece rollers 36 are in the retracted state based on the notification from the direction detection sensor 37. In the banknote cassette 17, after the central shaft 34 has been appropriately rotated under control of the banknote controller 11, the rotation can be stopped when the tongue piece rollers 36 are in the retracted state (FIG. 7A, FIG. 7B), and the tongue piece rollers 36 can be retained in the retracted state by maintaining this state.

Moreover, in the banknote cassette 17 (FIG. 3), a rotation shaft 41 and picker rollers 42 are provided at a position above the internal space 21S and to the front of the central shaft 31 and the feed rollers 32. In the banknote cassette 17, two of the picker rollers 42 are disposed at a predetermined separation to each other in the left-right direction.

The picker rollers 42 are configured in circular column shapes with substantially the same radius and thickness as the feed rollers 32. A high friction portion 42A with a higher coefficient of friction, similarly to the high friction portions 32A of the feed rollers 32, is attached to a portion of a circumferential side face of each of the picker rollers 42.

A bill stopper 29 is provided above a front side face inside the internal space 21S. The bill stopper 29 is attached to the casing 21 through a spring (not illustrated in the drawings). When a banknote hits the bill stopper 29, the action of the spring absorbs the shock of the impact.

In the banknote cassette 17, the guide bodies 53 accordingly substantially block the holes 25H2 of the conveyance guide 25 due to placing the tongue piece rollers 36, to which the guide bodies 53 are attached, in the retracted state.

1-3. Operation and Advantageous Effects

Figure 8:
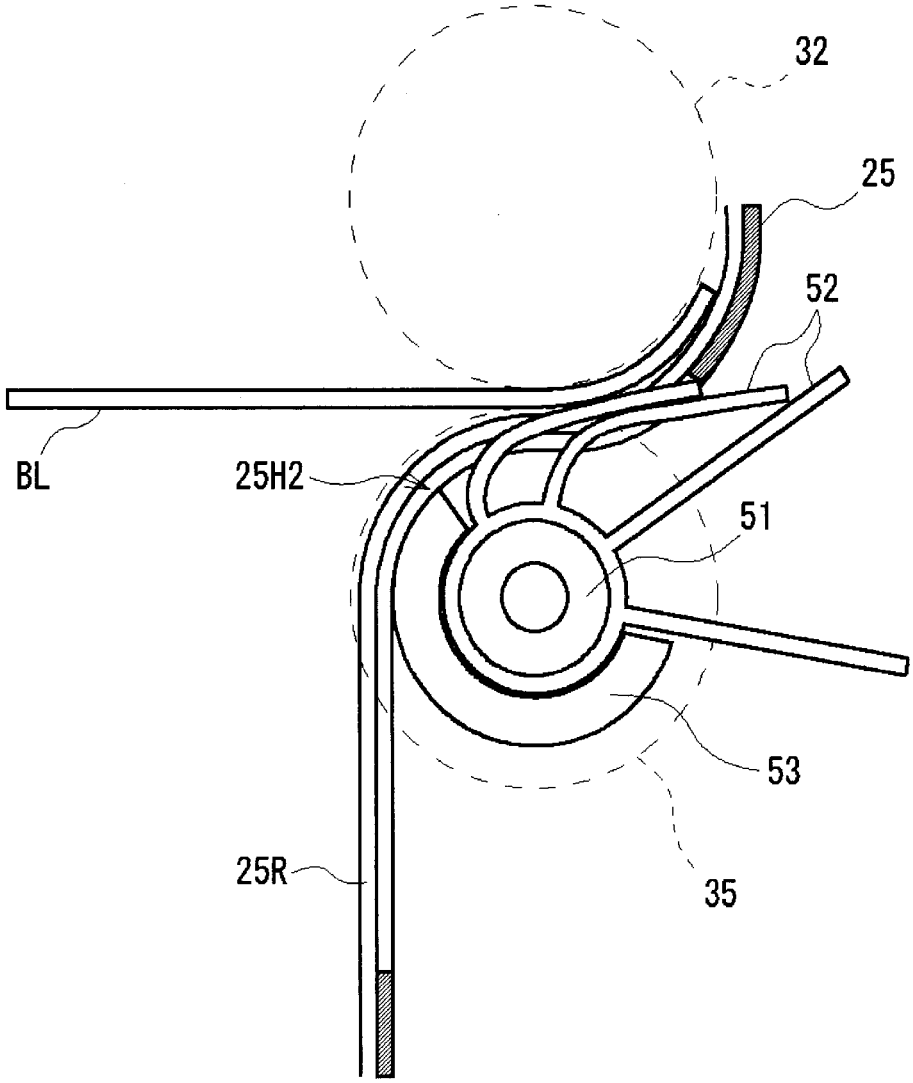
FIG. 8 is a schematic view illustrating deformation of tongue pieces during a stacking operation.

As illustrated in FIG. 8 corresponding to FIG. 3, in the configuration described above, for example during a stacking operation to stack and store banknotes BL inside the banknote cassettes 17 (FIG. 3) provided in the banknote pay-in/pay-out device 10 of the ATM 1 of the first exemplary embodiment, first, the stage 22 is moved downward while referring to the detection results of the uppermost face sensor, securing a predetermined separation between the stage uppermost face, and the ceiling face of the internal space 21S.

Further, under the control of the banknote controller 11, the banknote cassette 17 rotates the conveyance roller 27, the central shaft 31, the feed rollers 32, and the conveyance rollers 33 of the internal cassette conveyance section 23 in the arrow R1 direction, and rotates the conveyance roller 28, the central shaft 34, the separation rollers 35, the tongue piece rollers 36, and the tension rollers 38 in the arrow R2 direction.

The banknote cassette 17 initially moves a banknote BL passed over from the conveyance section 13 (FIG. 2) downward, nipped between the conveyance rollers 27 and 28, and then moves the banknote BL downward toward the front, nipped between the conveyance rollers 33 and the tension rollers 38, and then nipped between the feed rollers 32 and the separation rollers 35.

Figure 9:
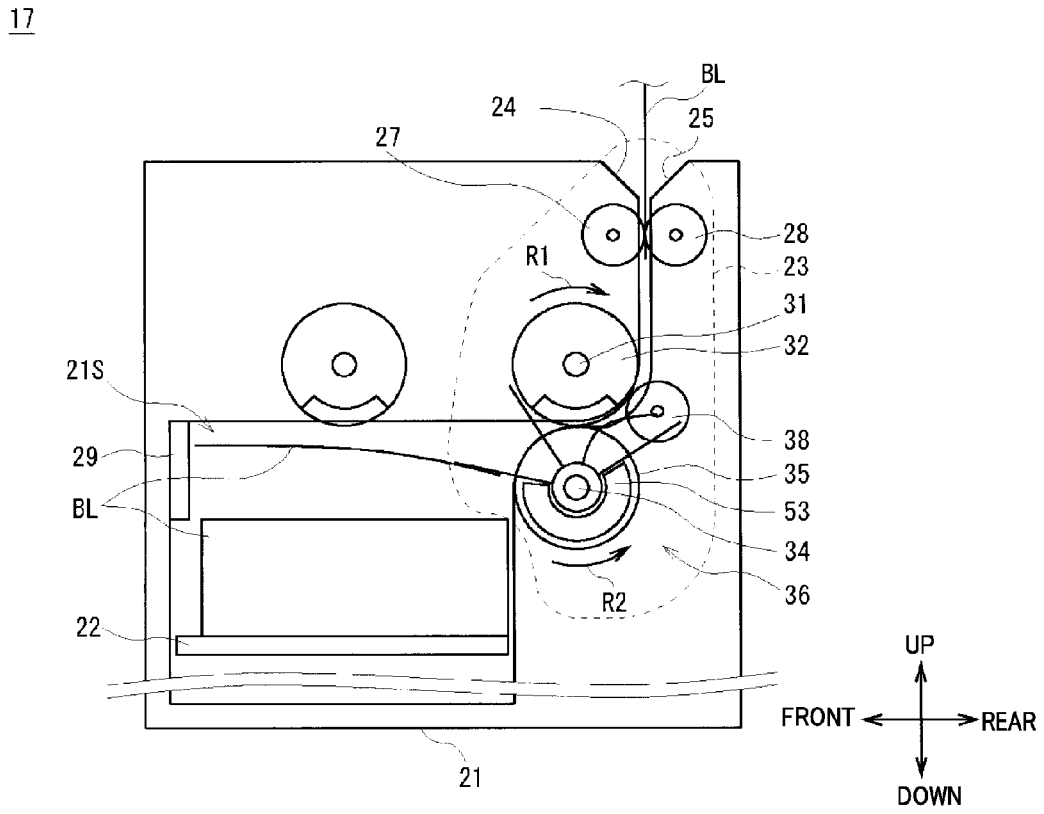
FIG. 9 is a schematic view illustrating banknote stacking.

As illustrated in FIG. 9, when this is performed, as the tongue pieces 52 of the tongue piece rollers 36 rotate in the arrow R2 direction, they are deformed due to contacting side edge portions of the holes 25H2 of the conveyance guide 25, the banknote BL, and the like.

Note that in the tongue piece rollers 36, since the central body 51 has a comparatively small radius, and is at a gap to the conveyance guide 25, the tongue pieces 52 do not stick out into the conveyance path 26, and can be sufficiently flexed further to the lower side than the conveyance guide 25, so as not to obstruct conveyance of the banknote BL.

The feed rollers 32 and the separation rollers 35 respectively rotate, thereby moving the nipped banknote BL toward the front, and discharging the banknote BL into the internal space 21S. The discharged banknote BL hits the bill stopper 29, and the shock is absorbed by the action of the spring, pushing the banknote BL back slightly toward the rear side.

Next, the tongue piece rollers 36 rotate in the arrow R2 direction, such that a rear end portion of the banknote BL is patted by the tongue pieces 52 and pressed down onto the upper face of the stage 22, or onto the uppermost face of the banknotes BL stacked on the upper face of the stage 22.

The tongue piece rollers 36 are rotated further in the arrow R2 direction, thereby generating frictional force with the banknote BL that has been pressed down onto the upper face of the stage 22 or the uppermost face of a banknote BL already stacked on the upper face of the stage 22, and dragging the banknote BL toward the rear, thus neatly stacking the banknote BL aligned at a position abutting the rear side face of the internal space 21S.

Figure 10:
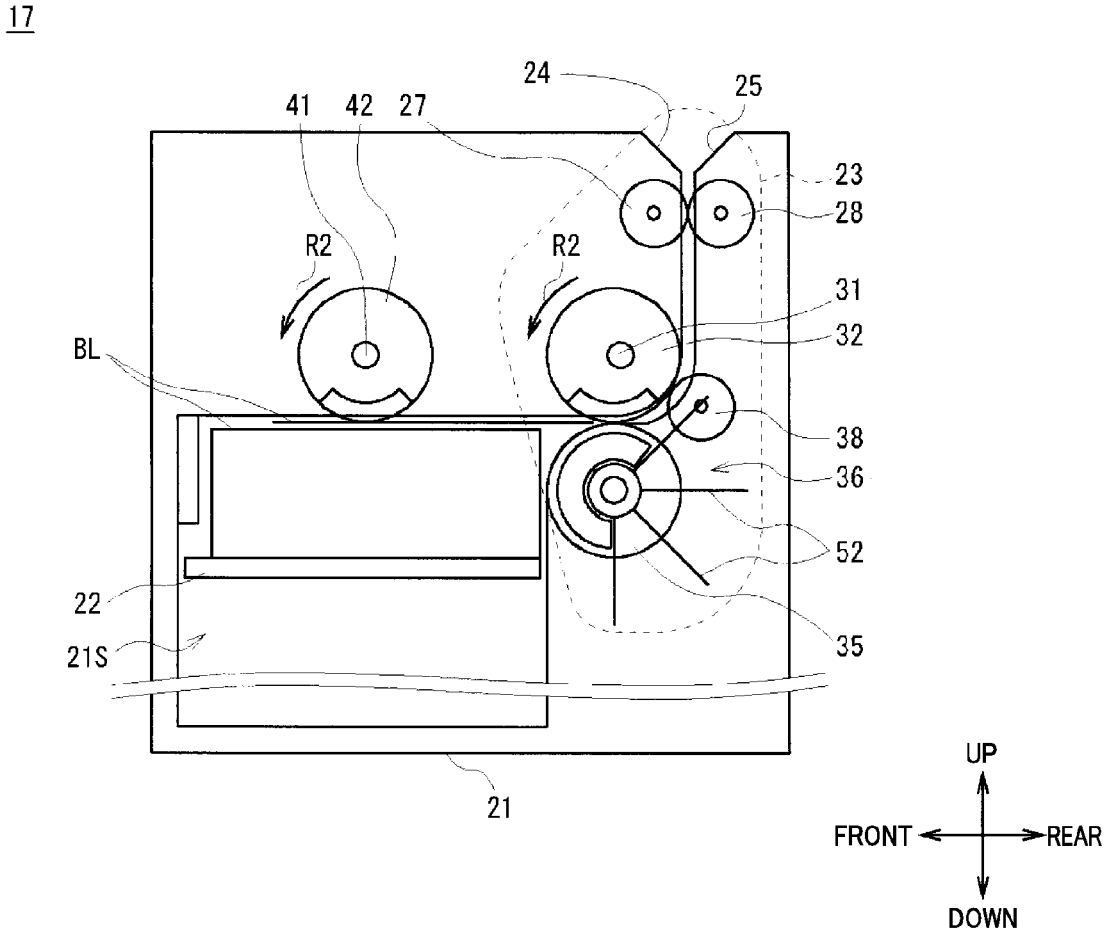
FIG. 10 is a schematic view illustrating banknote separation.

In a feed-out operation to separate and feed out banknotes BL inside the banknote cassette 17 one note at a time, as illustrated in FIG. 10 corresponding to FIG. 3, the stage 22 is moved upward, and the uppermost face of the banknotes BL stacked on the stage 22, namely the stage uppermost face, is made to contact lower side faces of the picker rollers 42.

Further, under the control of the banknote controller 11, the banknote cassette 17 rotates the central shaft 34 and the tongue piece rollers 36 while referring to the notification from the direction detection sensor 37, and stops the tongue piece rollers 36 in the retracted state.

Furthermore, under the control of the banknote controller 11, the banknote cassette 17 then rotates the conveyance roller 27, the central shaft 31, the feed rollers 32, the conveyance rollers 33, and the picker rollers 42 in the arrow R2 direction.

The picker rollers 42 generate frictional force between the high friction portions 42A and the banknote BL with the uppermost face, and apply rearward acting force to the banknote BL. The rear end of the banknote BL accordingly enters between the feed rollers 32 and the separation rollers 35.

Among the banknotes BL stacked on the stage 22, a certain amount of frictional force arises between the banknote BL with the uppermost face and the adjacent second banknote BL and below. Accordingly, there is a possibility that the rear edges of two or more notes in an overlapping state could attempt to enter between the feed rollers 32 and the separation rollers 35.

In this regard, without making the feed rollers 32 and the separation rollers 35 contact each other, the banknote cassette 17 leaves a very small gap just large enough to allow a single banknote BL to pass between the two. The separation rollers 35 are stopped, together with the central shaft 34 and the tongue piece rollers 36.

The banknote cassette 17 accordingly moves only the banknote BL with the uppermost face, and uses the static separation rollers 35 to block entry of the second banknote BL onwards. This thereby enables the banknote BL with the uppermost face to be separated on its own and moved along the conveyance path 26.

Note that as illustrated in FIG. 7A and FIG. 7B, in the conveyance guide 25, the outer circumferential face of the guide body 53 is positioned in the vicinity of the surface 25S, placing the upper front curved portions of the holes 25H2, through which the tongue pieces 52 of the tongue piece rollers 36 pass, in an almost completely blocked state.

As described above, as they circulate in the market, banknotes BL sometimes lose rigidity, for example due to being folded during handling.

Moreover, although banknotes BL are ideally moved with their short edges parallel to the direction of progress, namely with their long edges orthogonal to the direction of progress, sometimes they are moved with their short edges at an angle with respect to the direction of progress, namely travel skewed, for example due to differences in the frictional force acting on the banknote BL between the left and right picker rollers 42.

In such cases, the left-right direction positions of the corners of the banknote BL are different from the positions when a banknote BL is moving normally, namely moving with its short edges parallel to the direction of progress. When a banknote BL travels skewed, out of the left and right corners on both ends of the leading side in the direction of progress (namely the rear end side), the corner on the foremost side ends up ahead of the long edge and the other corner of the leading side.

Accordingly, when a banknote BL has poor rigidity or travels skewed, for example, there could be a possibility of the vicinity of a corner on the leading side (rear end side) drooping and attempting to enter the hole 25H2 when the rear end encounters the curved portion of the conveyance guide 25.

However, in the banknote cassette 17, the guide body 53 prevents such entry, and the vicinity of the corner slides against the outer circumferential face of the guide body 53 accompanying the rearward movement of the banknote BL, enabling the banknote BL to be gradually lifted upward.

Accordingly, in the banknote cassette 17, the vicinity of a corner of such a banknote BL having poor rigidity can be lifted sufficiently upward when arriving at the rear end of the holes 25H2, and the vicinity of the corner can be forestalled from catching on the side edge portions of the holes 25H2 and creasing.

In the banknote cassette 17, the banknote BL is then moved rearward and upward nipped between the conveyance rollers 33 and the tension rollers 38, is moved upward nipped between the conveyance rollers 27 and 28, and is passed over to the conveyance section 13.

Accordingly, in the banknote cassette 17, providing the tongue piece rollers 36 with the guide body 53 enables the risk of the vicinity of the corner catching on the side edge portions of the holes 25H2 of the conveyance guide 25 when feeding out the banknotes BL to be eliminated, and enables the banknotes BL to be fed out without sustaining damage.

In other words, the guide body 53 enables banknotes being conveyed along the conveyance guide 25 to be protected from damage.

Note that banknotes BL of various sizes are used, depending on the country and region. This results in a greater risk of corners overlapping with the positions of the tongue piece rollers 36 and the holes 25H2 and entering the holes 25H2 in the banknote cassette 17, particularly in the case of banknotes BL with a comparatively short length in the long edge direction.

In this respect, due to the operation of the guide bodies 53 provided to the tongue piece rollers 36, the banknote cassette 17 is capable of eliminating the risk of the corners of the banknotes BL entering the holes 25H2 and catching on the rear edges of the holes 25H2.

In the banknote cassette 17, the left-right direction positions of the tongue piece rollers 36 and the holes 25H2 can be made uniform, regardless of the long edge direction length of the banknotes used. This thereby enables easier design and a reduction in component types in the banknote cassette 17 according to the first exemplary embodiment, and also enables a reduction in costs associated with manufacture, maintenance and the like, in comparison to cases in which the positions are varied depending on the country or region.

According to the above configuration, in the banknote cassette 17 of the first exemplary embodiment, the guide bodies 53 are attached to the circumferential side faces of the central bodies 51 of the tongue piece rollers 36 over the range where the tongue pieces 52 are not provided. When feeding out the banknotes BL, the banknote cassette 17 stops the tongue piece rollers 36 in the retracted state, such that the outer circumferential faces of the guide bodies 53 are positioned in the vicinity of the surface 25S at the upper front curved portions of the holes 25H2 formed in the conveyance guide 25, thereby enabling the almost completely blocked state. Accordingly, the banknote cassette 17 of the first exemplary embodiment enables the vicinity of the corners of the banknotes BL to be prevented from entering the holes 25H2, and enables creasing of the banknotes during conveyance to be forestalled.

2. Second Exemplary Embodiment

An ATM 101 (FIG. 1) according to a second exemplary embodiment differs from the ATM 1 of the first exemplary embodiment in the point that a banknote pay-in/pay-out device 110 is provided in place of the banknote pay-in/pay-out device 10, but is configured similarly in other respects.

The banknote pay-in/pay-out device 110 (FIG. 2) differs from the banknote pay-in/pay-out device 10 of the first exemplary embodiment in for the point that banknote cassettes 117 are provided in place of the banknote cassettes 17, but is configured similarly in other respects.

The banknote cassettes 117 differ from the banknote cassettes 17 of the first exemplary embodiment in the point that tongue piece rollers 136 are provided in place of the tongue piece rollers 36, but are configured similarly in other respects.

Figure 11A:
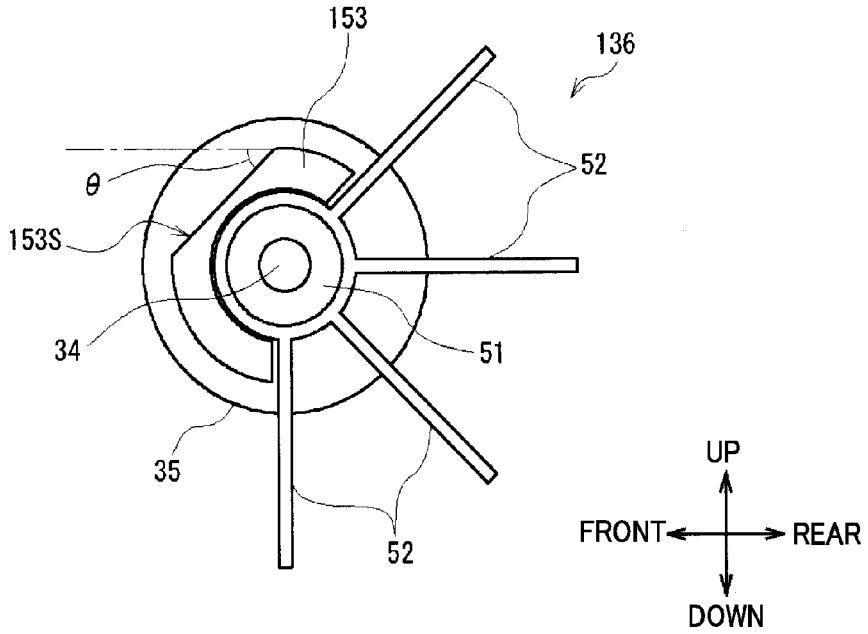
FIG. 11A is a schematic view illustrating configuration of a tongue piece roller according to a second exemplary embodiment.

As illustrated in FIG. 11A corresponding to FIG. 6A, the tongue piece rollers 136 differ from the tongue piece rollers 36 of the first exemplary embodiment in the point that guide bodies 153 are provided in place of the guide bodies 53, but are configured similarly in other respects.

The guide body 153 differs from the guide body 53 of the first exemplary embodiment in the point that a portion thereof is cut away to form an inclined face 153S, serving as a lifting face, the portion of the guide body 153 consituting a front upper portion in a case in a which the tongue piece roller 136 is in the retracted state.

The inclined face 153S is a flat face, and is formed so as to give an angle θ of approximately 45°, when in the retracted state, with respect to the horizontal direction, the horizontal direction being the direction of progress of the banknotes BL. Further, the surface of the inclined face 153S has a smooth finish.

In this configuration, when feeding out banknotes with the banknote cassette 117, similarly to in the first exemplary embodiment, the tongue piece rollers 136 are rotated as appropriate and stopped in the retracted state under control of the banknote controller 11.

The banknote cassette 117 also rotates the conveyance roller 27, the central shaft 31, the feed rollers 32, the conveyance rollers 33, and the picker rollers 42 in the arrow R2 direction, and the banknote BL with the uppermost face on the stage 22 is separated, and the rear end thereof enters between the feed rollers 32 and the separation rollers 35.

Figure 11B:
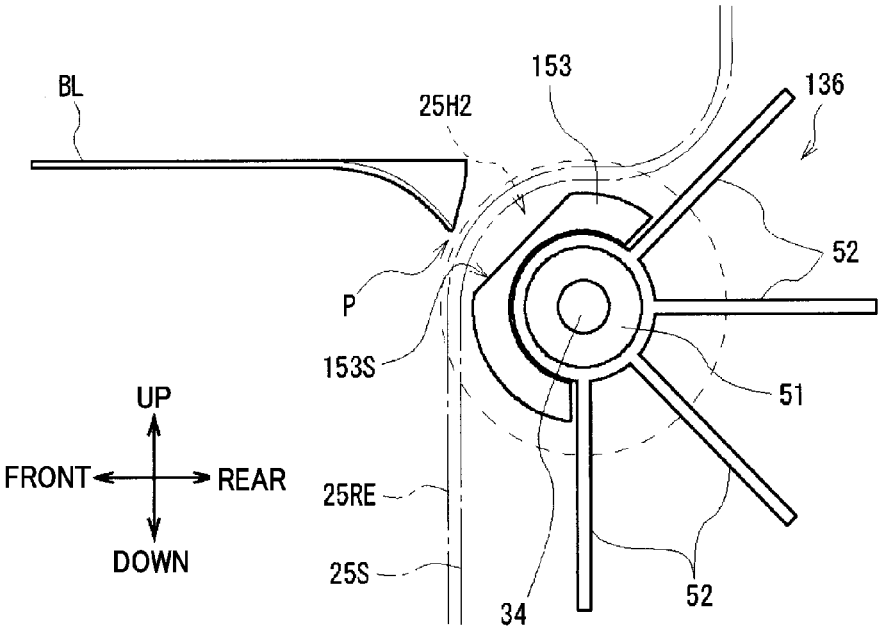
FIG. 11B is a schematic view illustrating configuration of a tongue piece roller according to the second exemplary embodiment.

Note that as illustrated in FIG. 11B, for example, when the rear end of a banknote BL with poor rigidity encounters the curved portion of the conveyance guide 25, it is conceivable that the vicinity of a corner P of the leading side (rear end side) could droop and attempt to enter the hole 25H2.

Even were the corner P on the leading side of the banknote BL to slightly enter the hole 25H2 accompanying its movement toward the rear, it would soon contact the inclined face 153S of the guide body 153. When this occurs, the corner P skims and slides over the inclined face 153S without catching, since the inclined face 153S forms the angle θ of approximately 45° with respect to the horizontal direction, this being the direction of progress of the banknote BL, and has a smooth surface.

The corner P is thus lifted gradually upwards while sliding over the inclined face 153S accompanying movement of the banknote BL toward the rear.

As a result, the banknote cassette 117 enables the vicinity of the corners of the banknote BL to be lifted sufficiently upward on reaching the rear edge of the holes 25H2. This thereby enables catching and creasing of the vicinity of the corner P on the rear edges of the holes 25H2 to be forestalled.

Further, suppose, for example, the corner P of the leading side of the banknote BL were to droop comparatively heavily and reach the vicinity of a lower end of the inclined face 153S. With the guide body 53 of the first exemplary embodiment, at the portion to be contacted firstly by the corner P the angle with respect to the horizontal plane would have a large value, for example between 75° and 90°. The guide body 53 would therefore be unable to allow the vicinity of the corner P to slide smoothly across as the banknote BL moves toward the rear, giving rise to the risk of creasing.

However, in the guide body 153 of the present exemplary embodiment, the angle θ formed between the inclined face 153S and the horizontal plane is uniform, and does not vary depending on the portion. Accordingly, as long as the corner P initially contacts the inclined face 153S, the guide body 153 can allow the corner P to slide smoothly over the inclined face 153S, and lift the corner P gradually upward.

The banknote cassette 117 according to the second exemplary embodiment otherwise obtains similar operation and advantageous effects to the banknote cassette 17 of the first exemplary embodiment.

According to the above configuration, in the banknote cassette 117 according to the second exemplary embodiment, the guide body 153 is attached to the circumferential side face of the central body 51 of the tongue piece roller 136 in the range where the tongue pieces 52 are not provided, and the guide body 153 is provided with the inclined face 153S. When feeding out the banknotes BL, the banknote cassette 117 stops the tongue piece rollers 136 in the retracted state, such that the outer circumferential faces of the guide bodies 153 are positioned in the vicinity of the surface 25S at the front upper curved portions of the holes 25H2 formed in the conveyance guide 25, enabling the almost completely blocked state to be achieved. Moreover, the angle θ formed by the inclined face 153S with respect to the horizontal plane can be set to approximately 45°. The banknote cassette 117 according to the second exemplary embodiment can accordingly prevent the vicinity of the corner P of the banknote BL from entering the hole 25H2 even when drooping comparatively heavily, enabling creasing during conveyance to be forestalled.

3. Other Exemplary Embodiments

In the first exemplary embodiment described above, explanation has been given regarding a case in which the outer circumferential face of the guide body 53 is slightly lower than the surface 25S (FIG. 7A, FIG. 7B) of the conveyance guide 25, namely close to the central shaft 34 side, when the tongue piece roller 36 is in the retracted state.

However, the present invention is not limited thereto, and for example, the outer circumferential face of the guide body 53 may be at the same position as the surface 25S of the conveyance guide 25, or may be at the same position as the ridge lines 25RE of the ribs 25R, when the tongue piece roller 36 is in the retracted state. Namely, the radius D2 of the guide body 53 may be set at various values within a range satisfying (radius D3 of conveyance guide 25)≥(radius D2 of guide body 53). The same applies in the second exemplary embodiment.

In the first exemplary embodiment described above, explanation has been given regarding a case in which the outer circumferential face of the guide body 53 is further to the central shaft 34 side than the ridge lines of the ribs 25R of the conveyance guide 25, namely is lower than the ribs 25R.

However, the present invention is not limited thereto, and, for example, configuration may be made such that at least a portion of the outer circumferential face of the guide body 53 is positioned further away than the ridge lines of the ribs 25R as viewed from the central shaft 34 when the tongue piece roller 36 is in the retracted state. Namely, a portion of the guide body 53 may be configured such that (radius D3 of the conveyance guide 25)<(radius D2 of the guide body 53). In such cases, the guide body 53 preferably does not impede movement of the banknote BL. The same applies in the second exemplary embodiment.

In the first exemplary embodiment described above, explanation has been given regarding a case in which in the tongue piece rollers 36, the guide body 53 is provided over the entire range of the outer circumferential face of the central body 51 where the tongue pieces 52 are not provided, spanning approximately 225°.

Figure 12:
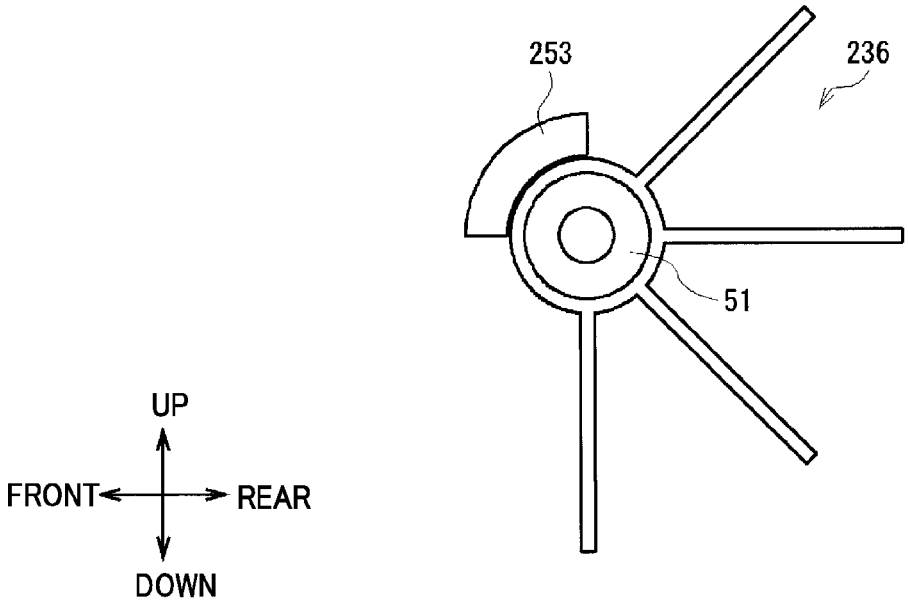
FIG. 12 is a schematic view illustrating configuration of a guide body according to another exemplary embodiment.

However, the present invention is not limited thereto, and the guide body may be provided over various ranges of the outer circumferential face of the central body 51. Specifically, as in the tongue piece roller 236 illustrated in FIG. 12, for example, a guide body 253 may be provided over a range of only approximately 90° spanning from the upper side to the front side when the tongue piece roller 236 is in the retracted state. Namely, it is sufficient that when the vicinity of a corner of a banknote BL attempts to enter the hole 25H2, the vicinity of the corner is allowed to slide and be lifted gradually upward accompanying the movement of the banknote BL. The same applies in the second exemplary embodiment.

In the second exemplary embodiment described above, explanation has been given regarding a case in which the inclined face 153S provided to the guide body 153 is configured in a flat plane shape.

Figure 13:
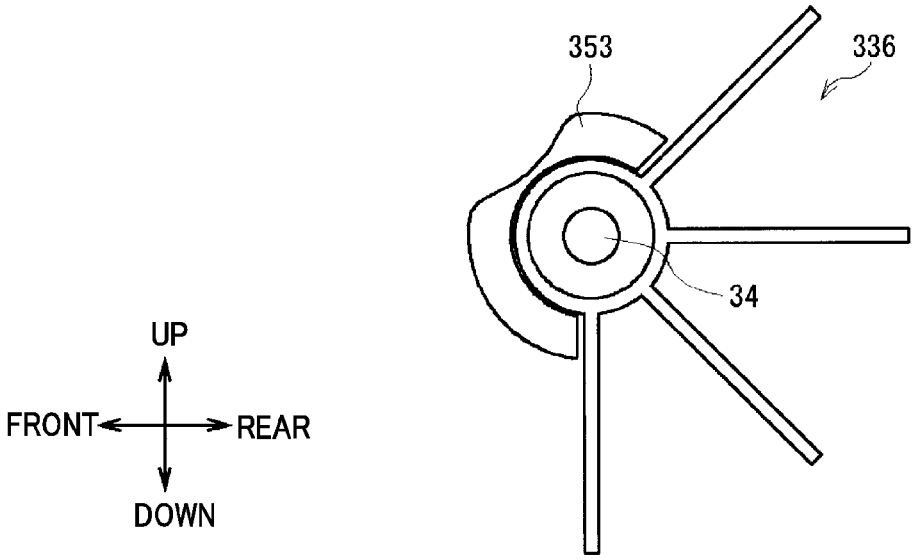
FIG. 13 is a schematic view illustrating configuration of a guide body according to another exemplary embodiment.

However, the present invention is not limited thereto, and the inclined face 153S may be configured with various curved shapes. Specifically, as in the tongue piece roller 336 illustrated in FIG. 13, a central portion as viewed along the left-right direction may be curved toward the central shaft 34 side, namely have a face curving so as to protrude downward, or, conversely, have a face curving so as to protrude upward.

In the above cases, it is sufficient that the guide body 53 or 153 can sufficiently block the front upper curved portion of the hole 25H2 of the conveyance guide 25, and can use the rearward movement of the banknote BL to allow the corner to slide and be lifted gradually upward when the corner of the banknote BL attempts to enter the hole 25H2.

In the second exemplary embodiment described above, explanation has been given regarding a case in which the inclined face 153S configures an angle θ of 45° with respect to the conveyance direction of the banknotes BL (namely the horizontal direction).

However, the present invention is not limited thereto, and configuration may be made with various angles. In such cases, although from the perspective of making the corner P (FIG. 11B) of the banknote BL traveling from the internal space 21S side contact the inclined face 153S it is necessary to separate the lower end of the inclined face 153S from the banknote BL conveyance path to a certain extent, the concern of being unable to lift the corner P and causing creasing becomes greater if the angle θ is too large. In consideration of this point, it is sufficient that the angle θ is between, for example, 15° and 60°, and the angle θ is preferably between 30° and 45°.

In the first exemplary embodiment described above, explanation has been given regarding a case in which the external diameter of the guide body 53, namely the apparent distance from the center Q of the central shaft 34 to the outer circumferential portion, is uniform regardless of the position in the left-right direction.

Figure 14:
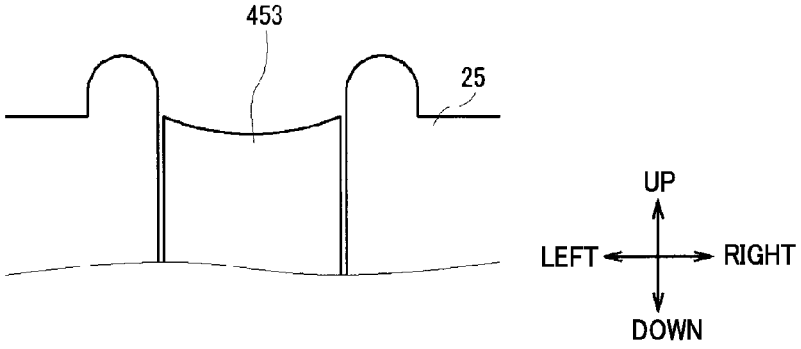
FIG. 14 is a schematic view illustrating configuration of a guide body according to another exemplary embodiment.
Figure 15:
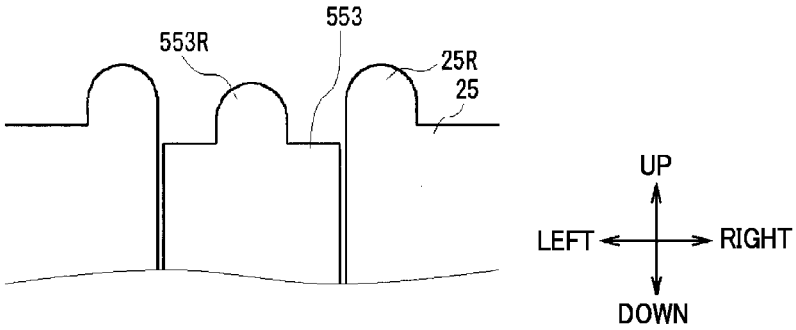
FIG. 15 is a schematic view illustrating configuration of a guide body according to another exemplary embodiment.

However, the present invention is not limited thereto, and the external diameter of the guide body 53 may vary depending on the position in the left-right direction. Specifically, as in the guide body 453 illustrated in the front view of FIG. 14, configuration may be made with a smaller external diameter at a central portion than at both end portions in the left-right direction, namely in a shape that curves so as to dip at the central portion, or, as in the guide body 553 illustrated in the front view of FIG. 15, the central portion in the left-right direction may be configured as a guide rib 553R projecting out further to the outside than its surroundings, with a rib shape similar to that of the ribs 25R of the conveyance guide 25. The same applies in the second exemplary embodiment.

In the first exemplary embodiment described above, explanation has been given regarding a case in which each individual guide body 53 has a shape with left-right symmetry, and the respective guide bodies 53 on the two tongue piece rollers 36 to the left and right have the same shape as each other.

Figure 16:
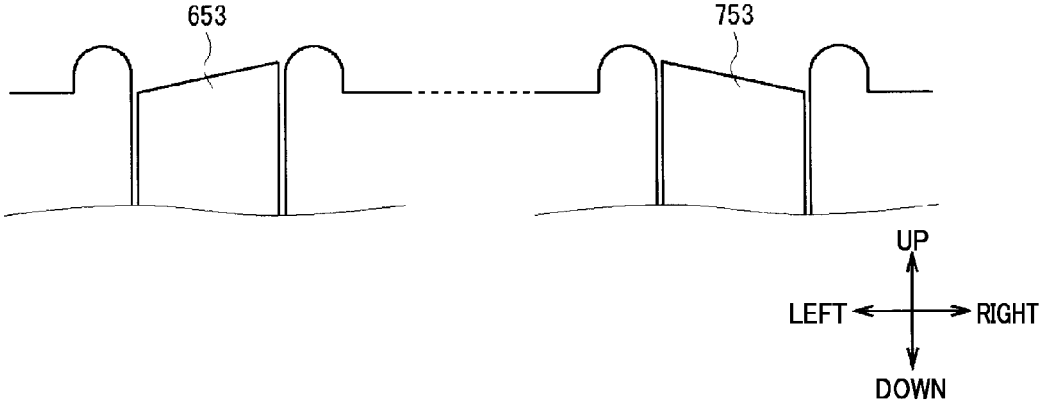
FIG. 16 is a schematic view illustrating configuration of a guide body according to another exemplary embodiment.
Figure 17:
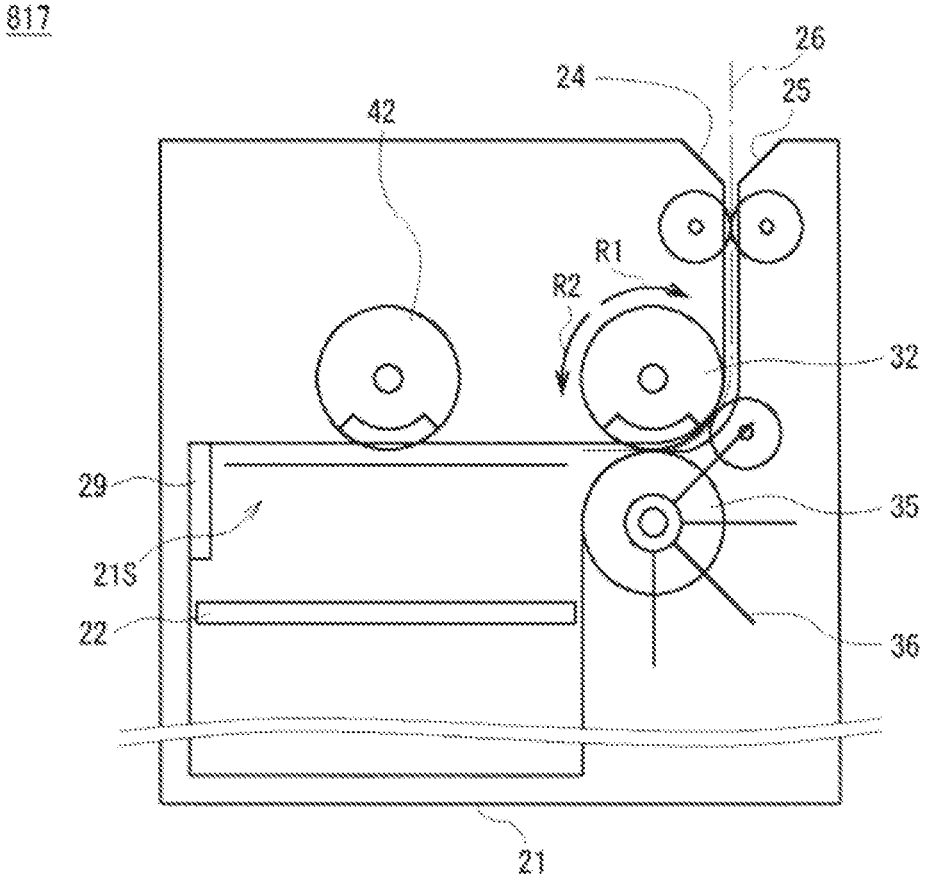
FIG.17 RELATED ART
FIG. 17 is a schematic view illustrating configuration of a conventional banknote cassette.
Figure 18:
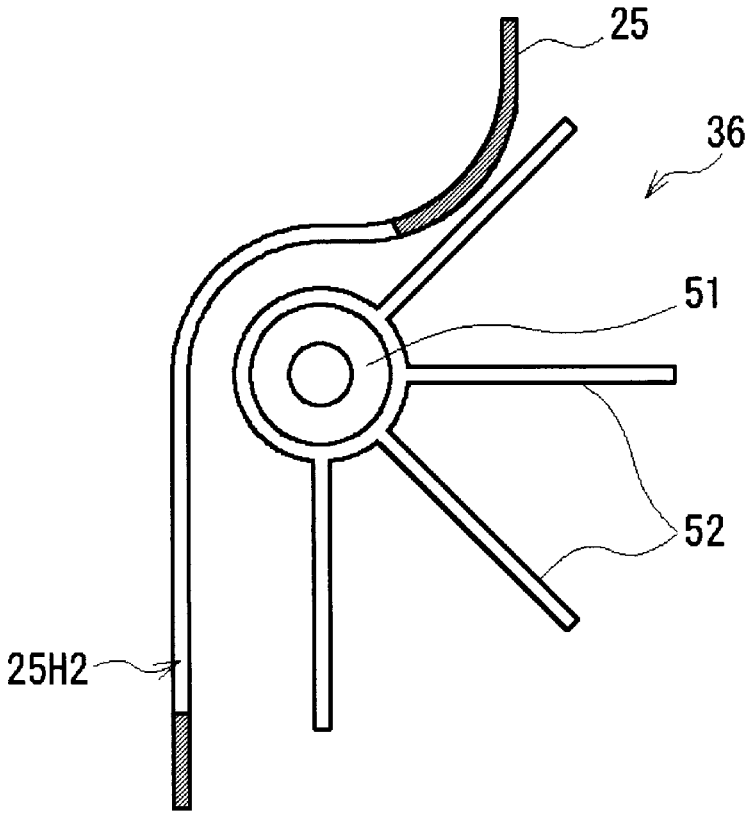
FIG.18 RELATED ART
FIG. 18 is a schematic view illustrating a relationship between a conventional conveyance guide and tongue piece roller.

However, the present invention is not limited thereto, and the respective guide bodies may be configured with different shapes having left-right symmetry to each other, for example as in the guide bodies 653 and 753 illustrated in the front view of FIG. 16. The same applies in the second exemplary embodiment.

Moreover, in the first exemplary embodiment described above, explanation has been given regarding a case in which the respective tongue pieces 52 of the tongue piece rollers 36 are integrally formed with the circular ring portion, and the circular ring portion is fitted onto the outer periphery of the central body 51.

However, the present invention is not limited thereto, and for example, the respective tongue pieces 52 may be formed independently, and respective central side portions thereof may be attached to the outer peripheral portion of the central body 51, or two of the tongue pieces 52 may be coupled together on the central body 51 side, and the coupling portion may be fixed to the central body 51. The same applies in the second exemplary embodiment.

In the first exemplary embodiment described above, explanation has been given regarding a case in which the central body 51, the tongue pieces 52, and the guide body 53 are configured as independent components that are combined together to configure the tongue piece roller 36.

However, the present invention is not limited thereto, and any or all of the central body 51, the tongue pieces 52, and the guide body 53 may be configured as integral components and combined together with the remaining components to configure the tongue piece roller 36. For example, the central body 51 and the respective tongue pieces 52 may be configured as integral components and combined with the guide body 53 to configure the tongue piece roller 36. The same applies in the second exemplary embodiment.

In the first exemplary embodiment described above, explanation has been given regarding a case in which two of the tongue piece rollers 36 are provided in the banknote cassette 17.

However, the present invention is not limited thereto, and one, or three or more, of the tongue piece rollers 36 may be provided in the banknote cassette 17. In such a configuration, the guide bodies 53 of the tongue piece rollers 36 may all be configured with the same shape, or may be configured with different shapes depending on their positions in the left-right direction. The same applies in the second exemplary embodiment.

In the first exemplary embodiment described above, explanation has been given regarding a case in which the ribs 25R are formed to the conveyance guide 25 to reduce friction with the banknotes BL moving along the conveyance path 26.

However, the present invention is not limited thereto, and for example, the ribs 25R may be omitted in cases in which the surface 25S of the conveyance guide 25 has a low coefficient of friction. In such a configuration, the outer circumferential face of the guide body 53 preferably does not project out further to the conveyance path 26 side than the surface 25S when the tongue piece roller 36 is in the retracted state, so as not to impede movement of the banknotes BL. The same applies in the second exemplary embodiment.

In the first exemplary embodiment described above, explanation has been given regarding a case in which the conveyance guide 25 is curved in a circular arc shape following the outer circumferential face of the separation rollers 35 in the vicinity of the terminal end portion on the front lower side of the conveyance path 26.

However, the present invention is not limited thereto, and for example, the conveyance guide 25 may be curved in various curved shapes such as bent shapes or elliptically curved shapes as viewed along the left-right direction. In such cases, it is sufficient that the banknotes BL can be separated one note at a time by the gap between the separation rollers 35 and the feed rollers 32 when feeding out the banknotes BL. The same applies in the second exemplary embodiment.

The present invention is not limited to the respective exemplary embodiments described above and the other exemplary embodiments described above. Namely, the present invention encompasses application to exemplary embodiments combining some or all of the respective exemplary embodiments described above and the other exemplary embodiments described above, and exemplary embodiments deriving from elements thereof.

In the first exemplary embodiment described above, explanation has been given regarding a case in which the internal cassette conveyance section 23 is provided to the banknote cassette 17 that internally stacks and stores banknotes BL conveyed from the conveyance section 13, and that separates and feeds out internally stacked banknotes BL one note at a time.

However, the present invention is not limited thereto, and the internal cassette conveyance section 23 may be provided at locations, such as the pay-in/pay-out section 12, that at least separate and feed out internally stacked banknotes BL. The same applies in the second exemplary embodiment.

In the first exemplary embodiment described above, explanation has been given regarding a case in which the guide bodies 53 are provided to the tongue piece rollers 36, that pat down banknotes BL discharged into the internal space 21S onto the stage 22, provided to the internal cassette conveyance section 23 of the banknote cassette 17 that internally stacks banknotes.

However, the present invention is not limited thereto, and the guide body 53 may be provided to tongue piece rollers 36 installed at various locations that convey banknotes along a conveyance guide, such as along the conveyance path of the conveyance section 13. The same applies in the second exemplary embodiment.

In the first exemplary embodiment described above, explanation has been given regarding a case in which the banknote controller 11 that performs overall control of the banknote pay-in/pay-out device 10 controls rotation of the central shaft 34, etc. to rotate or stop the tongue piece rollers 36.

However, the present invention is not limited thereto, and for example, a dedicated controller configured similarly to the banknote controller 11 may be provided to the banknote cassette 17 or the internal cassette conveyance section 23. This dedicated controller may rotate or stop the tongue piece rollers 36 by controlling rotation of the central shaft 34, etc. The same applies in the second exemplary embodiment.

In the first exemplary embodiment described above, explanation has been given regarding a case in which the present invention is applied to the banknote cassette 17 that stores banknotes BL, serving as a medium, in the ATM 1 that performs processing relating to cash transactions with a customer.

However, there is no limitation thereto, and the present invention may, for example, be applied to locations that separate and feed out stacked banknotes BL one note at a time in various devices that handle banknotes BL, such as banknote processing devices (known as teller machines) employed by service counter staff at service counters in financial institutions and the like. Moreover, the present invention may be applied to locations that separate and feed out a medium in a stacked state one sheet at a time in various devices handling various paper sheet shaped media including various cash vouchers, securities, tickets or postcards. The same applies in the second exemplary embodiment.

In the exemplary embodiments described above, explanation has been given regarding cases in which the internal cassette conveyance section 23 serving as a medium protection device is configured by the conveyance guide 25 serving as a conveyance guide, the central shaft 34 serving as a central shaft, the tongue piece roller 36 serving as a tongue piece roller, the hole 25H2 serving as a through hole, and the guide body 53 serving as a guide body.

However, the present invention is not limited thereto, and a medium protection device may be configured by conveyance guides, central shafts, tongue piece rollers, through holes, and guide bodies of various other configurations.

In the exemplary embodiments described above, explanation has been given regarding cases in which the banknote cassette 17 serving as a medium separating and stacking device is configured by the internal space 21S serving as a space, the conveyance guide 25 serving as a conveyance guide, the central shaft 34 serving as a central shaft, the tongue piece roller 36 serving as a tongue piece roller, the hole 25H2 serving as a through hole, and the guide body 53 serving as a guide body.

However, the present invention is no limitation thereto, and a medium separating and stacking device may be configured by spaces, conveyance guides, central shafts, tongue piece rollers, through holes, and guide bodies of various other configurations.

INDUSTRIAL APPLICABILITY

The present invention may be employed in various devices that stack and separate paper sheet shaped media.

The disclosure of Japanese Patent Application No. 2013-124043 is incorporated in its entirety by reference herein.

All cited documents, patent applications and technical standards mentioned in the present specification are incorporated by reference in the present specification to the same extent as if the individual cited document, patent application, or technical standard was specifically and individually indicated to be incorporated by reference.

The invention claimed is:

1. A medium protection device, comprising:

a conveyance guide forming a conveyance path of a paper sheet shaped medium;

a central shaft that is substantially orthogonal to a direction of progress of the medium along the conveyance path, that is substantially parallel to a face of the medium conveyed on the conveyance path, and that is separated by a predetermined distance from a location on the conveyance guide closest to the conveyance path;

a tongue piece roller including a central body that has a radius from the central shaft of less than the predetermined distance and that rotates about the central shaft, and at least one flexible tongue piece that is provided projecting out from the central body within a predetermined provision range of an outer circumferential portion of the central body;

a through hole formed in the conveyance guide, the tongue piece passing through the through hole during rotation of the central body about the central shaft; and a guide body that is provided in a non-provision range, excluding the provision range of the outer circumferential portion of the central body, and that is positioned further outward than the outer circumferential portion.

2. The medium protection device of claim 1, wherein:

the conveyance guide includes a curved portion that is curved so as to extend around the central shaft; and the guide body is formed with a lifting face that is disposed at a decreasing distance to the conveyance path on progression toward a opposite direction to the direction of progress of the medium, wherein when the tongue piece roller has been stopped in a predetermined state with respect to the conveyance path, an angle formed by the lifting face and the direction of progress of the medium is a predetermined maximum size or smaller.

3. The medium protection device of claim 2, wherein the lifting face of the guide body is a flat face.

4. The medium protection device of claim 3, wherein the predetermined maximum size is 45°.

5. The medium protection device of claim 1, further comprising:

a roller that is configured with a circular column shape centered on the central shaft, and that includes a portion exposed to the conveyance path through a roller-exposing hole formed in the conveyance guide and contacting the medium on the conveyance path; wherein the conveyance guide includes a curved portion curving in a circular arc shape along an outer circumferential face of the roller; and an outer circumferential face of the guide body has a circular arc shape disposed at a distance from the central shaft of the distance to the curved portion of the conveyance guide or less.

6. The medium protection device of claim 1, wherein:

the conveyance guide includes, on a conveyance path side surface, a conveyance guide rib that projects out further to the conveyance path and that runs along the direction of progress of the medium; and a portion of the guide body that is furthest from the central shaft is disposed closer to the central shaft than a ridge portion of the conveyance guide rib.

7. The medium protection device of claim 1, wherein in the guide body, an outer circumferential portion of the guide body that is furthest from the central shaft differs in distance to the central shaft depending on the position along the central shaft.

8. The medium protection device of claim 7, wherein in the guide body, the outer circumferential portion of the guide body that is furthest from the central shaft is formed with a guide body rib projecting out further in a direction away from the central shaft.

9. A medium separating and stacking device, comprising:

a space in which a paper sheet shaped medium is stacked;

a conveyance guide that is in communication with the space and that forms a conveyance path of the medium;

a central shaft that is substantially orthogonal to a direction of progress of the medium along the conveyance path, that is substantially parallel to a face of the medium conveyed on the conveyance path, and that is separated by a predetermined distance from a location on the conveyance guide closest to the conveyance path;

a tongue piece roller including a central body that has a radius from the central shaft of less than the predetermined distance and that rotates about the central shaft, and at least one flexible tongue piece that is provided projecting out from the central body within a predetermined provision range of an outer circumferential portion of the central body;

a through hole formed in the conveyance guide, the tongue piece passing through the through hole during rotation of the central body about the central shaft; and a guide body that is provided in a non-provision range excluding the provision range of the outer circumferential portion of the central body, and that is positioned further outward than the outer circumferential portion.

10. The medium separating and stacking device of claim 9, further comprising:

a roller that is configured with a circular column shape centered on the central shaft, and that includes a portion exposed to the conveyance path through a roller-exposing hole formed in the conveyance guide and contacting the medium on the conveyance path; wherein the central shaft is disposed at a location separated by substantially the predetermined distance from a direction of progress end portion of the conveyance guide;

the end portion of the conveyance guide includes a curved portion curved along an outer circumferential face of the roller; and the guide body is formed with a lifting face that is disposed at a decreasing distance to the conveyance path on progression toward a opposite direction to the direction of progress of the medium, wherein when the tongue piece roller has been stopped in a predetermined state with respect to the curved portion, an angle formed by the lifting face and the conveyance path is a predetermined maximum size or smaller.

* * * * *